US006203109B1

(12) United States Patent
Bergsten et al.

(10) Patent No.: US 6,203,109 B1
(45) Date of Patent: Mar. 20, 2001

(54) ERGONOMIC ARM SUPPORT

(75) Inventors: Jeffrey D. Bergsten, Brooklyn Park; Donald A. Bergsten, Eden Prairie, both of MN (US)

(73) Assignee: Industrial Ergonomics, Inc., Burnsville, MN (US)

( * ) Notice: Subject to any disclaimer, the term of this patent is extended or adjusted under 35 U.S.C. 154(b) by 0 days.

(21) Appl. No.: 09/474,503

(22) Filed: Dec. 29, 1999

Related U.S. Application Data

(63) Continuation-in-part of application No. 09/196,291, filed on Nov. 19, 1998, now Pat. No. 6,022,079, which is a continuation-in-part of application No. 08/951,851, filed on Oct. 16, 1997, now Pat. No. 5,851,054, which is a continuation of application No. 08/482,807, filed on Jun. 7, 1995, now abandoned, which is a continuation-in-part of application No. 08/326,825, filed on Oct. 20, 1994, now Pat. No. 5,597,207, which is a continuation-in-part of application No. 08/141,196, filed on Oct. 21, 1993, now Pat. No. 5,369,805, which is a continuation-in-part of application No. 07/755, 432, filed on Sep. 5, 1991, now Pat. No. 5,281,001.

(51) Int. Cl.[7] ..... A47C 7/54

(52) U.S. Cl. ..... 297/411.35; 297/411.36; 297/411.37; 297/411.38

(58) Field of Search ..... 297/411.35, 411.37, 297/411.36, 411.38, 411.24, 411.25, 411.26, 411.27, 411.28, 411.29, 411.3, 411.31; 248/118, 118.1, 118.3, 118.5

(56) References Cited

U.S. PATENT DOCUMENTS

| | | |
|---|---|---|
| D. 332,703 | 1/1993 | Gulliver . |
| 607,675 | 7/1898 | Barr . |
| 1,721,221 | 7/1929 | Jauregui . |
| 2,704,114 | 3/1955 | Williams . |
| 4,159,148 | 6/1979 | Schulz . |
| 4,332,263 | 6/1982 | Kitrell . |
| 4,481,556 | 11/1984 | Berke et al. . |
| 4,621,781 | 11/1986 | Springer . |
| 4,688,862 | 8/1987 | Fowler et al. . |

(List continued on next page.)

OTHER PUBLICATIONS

Linear Industries Ltd., Catalog, Second Edition Copyright 1975, 1979.

Turnomat Slide Bearing Assemblies, Shafts & Gibs Literature from Linear Industries Ltd., Monrovia, California, pp. 1–7.

Linear Industries Ltd., Product Selection Guide, pp. 1–37.

ErgoArm by Sit–rite Product Brochure, 4 pages (unpaginated and undated).

Rini Ergoteknik ab Product Brochure, 2 pages (unpaginated) dated Dec. 15, 1985.

(List continued on next page.)

*Primary Examiner*—Milton Nelson, Jr.
(74) *Attorney, Agent, or Firm*—Vidas, Arrett & Steinkraus

(57) ABSTRACT

An ergonomic arm support for supporting the forearm during typing, keying, or assembly operations. The arm support includes an armrest pivotally mounted on a shroud for sliding the armrest to and away from a cantilever disk which is secured to a table or chair. The shroud is pivotally slidable or repositionable relative to the cantilever disk such that the armrest, which is pivotal relative to the shroud may be positioned to provide a wide range of locations for positioning of an individual's forearms. The cantilever disk permits easy or convenient inward, outward, forward, or backward positioning of an armrest relative to an object where the cantilever disk frictionally engages the shroud to lock the armrest into a desired position during use. The shroud may also function as an enclosure of the cantilever disk to prevent inadvertent engagement between an individual and/or the individual's clothes and the cantilever disk.

21 Claims, 21 Drawing Sheets

U.S. PATENT DOCUMENTS

| | | | |
|---|---|---|---|
| 4,789,249 | | 12/1988 | Mutolo . |
| 4,815,862 | | 3/1989 | Mugglestone et al. . |
| 4,822,103 | | 4/1989 | Stenvall . |
| 4,961,610 | | 10/1990 | Reeder et al. . |
| 4,997,054 | | 3/1991 | Denny et al. . |
| 5,058,840 | | 10/1991 | Moss et al. . |
| 5,104,073 | | 4/1992 | VanBeek et al. . |
| 5,108,057 | | 4/1992 | Dandy, III et al. . |
| 5,143,422 | | 9/1992 | Althofer et al. . |
| 5,281,001 | | 1/1994 | Bergsten et al. . |
| 5,318,347 | | 6/1994 | Tseng . |
| 5,335,888 | | 8/1994 | Thomsen . |
| 5,369,805 | | 12/1994 | Bergsten et al. . |
| 5,380,065 | | 1/1995 | Rohrer . |
| 5,388,892 | | 2/1995 | Tornero . |
| 5,393,124 | | 2/1995 | Neil . |
| 5,398,896 | | 3/1995 | Terbrack . |
| 5,439,268 | | 8/1995 | Dozsa-Farkas . |
| 5,484,187 | | 1/1996 | Doerner et al. . |
| 5,513,898 | | 5/1996 | Kanai et al. . |
| 5,586,811 | * | 12/1996 | Tornero . |
| 5,590,934 | | 1/1997 | Gibbs . |
| 5,597,207 | | 1/1997 | Bergsten et al. . |
| 5,655,814 | * | 8/1997 | Gibbs . |
| 5,660,442 | * | 8/1997 | Tornero . |
| 5,876,097 | * | 3/1999 | Cao . |
| 5,927,811 | * | 7/1999 | Tseng . |
| 6,059,366 | * | 5/2000 | Hu . |

OTHER PUBLICATIONS

Rini Ergoteknik ab Product Brochure, 2 pages (unpaginated) dated 1990.
Mabs Arm Product Brochure, 3 pages, (unpaginated and undated).
THK literature, page 7 (one page), THK LM Guide Type SR . . . T/S, (undated).
THK literature, page 48 (one page), THK type DP, (undated).
THK literature, page 122 (one page), THK Ball Spline Type LMT, (undated).
THK literature, one page (unpaginated), on epochal linear motion systems, (undated).
Unidentified Literature on Spline Shafts, page 100 (one page), (undated).
Thomas Systems Literature on 1AC Double Shaft Unsupported System with carriage, page 31 (one page), (undated).
LM76 Inc., Product Brochure on Ceramic Linear Motion Bearings, 1 page, (unpaginated and undated).
Pacific Bearing Co., Product Brochure entitled Linear Bearing Selection Guide, 1 page, (unpaginated and undated).
PowerTrax Literature, pages 4–5 (two pages), regarding Power–Trax bal splines, (undated).
Occupational Health & Safety, Sep. 1991, "Moving Armrest" and Ergo Chair product information, page 56 (three pages).
Pamphlet entitled Relax Armrest from rh form ab of Bodafors, Sweden, 4 pages (unpaginated), dated Jan. 1991.
The Mills TS Series Linear Slides, Catalog TS101–3 dated 1991, 14 pages.
The Mills "EZ1" Series Linear Slides, Supplemental Catalog No. EZ101–2 dated 1992, 16 pages.
The Mills SE Series Linear Slides, SE Issue 3, 12 pages, dated 1992.
1994 Office Furniture Catalog, SOS Office Furniture New and Used, pages 51F and 53F (three pages).
AliMed Ergonomics and Occupational Health Catalog, Fall/Winter 1994, pages 11 and 13 (three pages).
Bertelson Office Products 1994 Catalog, pages 43, 45 and 47 (four pages).

* cited by examiner

ERGONOMIC ARM SUPPORT

CROSS-REFERENCE TO RELATED APPLICATIONS

The present invention is a continuation-in-part of application Ser. No. 09/196,291 filed Nov. 19, 1998 now U.S. Pat. No. 6,022,079 which is a continuation-in-part of Ser. No. 08/951,851 filed Oct. 16, 1997, now U.S. Pat. No. 5,851,054 which is a continuation application of application Ser. No. 08/482,807 filed Jun. 7, 1995 now abandoned, which is a continuation-in-part application of application Ser. No. 8/326,825, filed Oct. 20, 1994, U.S. Pat. No. 5,597,207, dated Jan. 28, 1997, which is a continuation-in-part of application Ser. No. 08/141,196, filed Oct. 21, 1993, U.S. Pat. No. 5,369,805, dated Dec. 6, 1994, which is a continuation-in-part of application Ser. No. 07/755,432, filed Sep. 5, 1991, U.S. Pat. No. 5,281,001 dated Jan. 25, 1994, and relates to an arm support and, more particularly, to an arm support with a an adjustable armrest. The entire contents of all of the related applications and patents cited above is hereby incorporated by reference.

STATEMENT REGARDING FEDERALLY SPONSORED RESEARCH

Not Applicable.

BACKGROUND OF THE INVENTION

Ergonomics may be defined as an engineering and physiological study of relationships between man and machines. An ergonomic device may be a device that is tailored to reflect human structure and function to, for example, enhance a person's ability to operate the device or an adjacent apparatus.

An ergonomic device may enhance a worker's performance or ability to operate a machine by relieving fatigue. For example, fatigue or repetitive motion disorders of the hand, wrist, and arm may be caused by repetitive or tedious hand, wrist, and arm functions. In the computerized environment, keyboard operators may spend their entire workdays at terminals with their forearms extended to their keyboards. Postal workers may spend long periods of time with their forearms extended to operate coding machines for coding and sorting mail. Assembly-line personnel may also work with their forearms extended over articles of manufacture to manipulate tiny parts with their fingers.

Ergonomic arm support devices have been designed for supporting the forearm of keyboard operators. Each of these devices typically consist of two arms with one arm secured to a desk and the second arm having a cushion at its distal end for supporting the forearm. These arms are frequently jointed at their connection, and also may be jointed at the forearm cushion and at the connection to the keyboard table for a total of three joints.

These jointed arm support devices have a number of problems. For example, the inclusion of two arms and three joints for a single device requires that the arm be secured to the keyboard table and positioned at a relatively great distance from the keyboard in order to provide sufficient space for mounting the jointed arm. Accordingly, a pair of such arm support devices may require a larger desk, and therefore may disadvantageously occupy a greater amount of work space than is otherwise required. If the arm supports are in fact mounted closer to the terminal, the range of motion of each of the arm supports is limited, and the arm supports may dig into a worker's torso or interfere with his or her chair.

A similar problem concerns the impracticality of mounting the conventional jointed arm support on a chair. If this type of arm support is mounted on a chair, the long reach of its jointed two arms may interfere with access to the seat of the chair. Furthermore, the jointed arm support simply may not be reasonably operable on a chair because a chair, by its very nature, is drawn adjacent to the keyboard to a position in which the torso of the occupant of the chair or the keyboard may interfere with a range of motion of the second arm.

Another problem with the conventional jointed arm support is that it easily breaks when leaned upon. It is typical behavior for a worker to lean and exert downward pressure or weight on the cushioned or distal end of the second arm of the conventional arm support which is intended for supporting only the weight of a forearm. The leverage or force exerted by the weight of such a lean or end loading is magnified by the overall length of the two arms of the jointed arm support.

Still another problem with the jointed arm support is that it is difficult to maneuver. For example, when one arm is aligned directly over the other arm, and the intended direction of movement of the forearm is in line with the two arms, the arms initially resist pivoting relative to each other until the forearm exerts a force out of alignment with the two arms. Accordingly, such a conventional jointed arm support may not meet the definition of an ergonomic device that typically tracks or follows a natural movement of the human body without resistance.

Yet another problem is that the conventional two-arm jointed arm support may not decrease substantially the risk of carpal syndrome. This syndrome may be caused at least in part by the tendency of a keyboard operator to rest his or her wrists on the keyboard, or on a portion of the table immediately in front of the keyboard, while his or her hands are elevated relative to the wrists for operation of the keyboard. With the long reach of the two-arm jointed arm support, and the attendant amount of leverage, the arm cushion on the distal end of the second arm may sink to the table surface even under the relatively light weight of an arm. Even providing for height adjustment, such instability or deflection of the second arm may not provide a sufficient lift for the wrists to be held at the proper elevation relative to the hands to minimize the risk of carpal syndrome.

SUMMARY OF THE INVENTION

An ergonomic arm support for supporting the forearm during typing, keying, or assembly operations. The arm support includes an armrest pivotally mounted on a shroud for slidably positioning the armrest to and away from a cantilever disk which is secured to an object or chair. The shroud is pivotally slidable or repositionable relative to the cantilever disk such that the armrest, which is pivotal relative to the shroud may be positioned to provide for a wide range of locations for positioning of an individuals forearms. The cantilever disk permits easy or convenient inward, outward, forward, or backward positioning of an armrest relative to an object where the cantilever disk frictionally engages the shroud to lock the armrest into a desired position during use. The shroud may also function as an enclosure for the cantilever disk to prevent inadvertent engagement between an individual and/or the individual's clothes and the cantilever disk.

An object of the present invention is to provide an arm support which may be easily and quickly repositioned by an individual.

Another object of the present invention is to provide a strong and durable arm support.

Still another object of the present invention is to provide an arm support which includes an armrest which is easily fixedly positioned relative to an object during use by an individual.

Still another object of the present invention is to provide an arm support of relatively simple and inexpensive design, construction, and operation which fulfills the intended purpose of supporting an arm without risk of injury to persons and/or damage to property.

Still another object of the present invention is to provide an arm support having a single mechanism to permit inward, outward, forward, and/or backward positioning of an armrest which may be fixed in a desired location during use by the downward application of weight upon the armrest.

Still another object of the present invention is to provide an arm support having a simple mechanism which may be easily manipulated and repositioned into a new desired location by removal of downward weight or force from the armrest via the interrelationship between the shroud and a cantilever disk.

Still another object of the present invention is to provide a cantilever effect for positioning and repositioning of an armrest relative to an individual and to an object to secure the armrest in a desired location.

A feature of the present invention is an arm support having an armrest for engaging a forearm for being secured to an object such as a table or chair.

Another feature is the provision in such an arm support, of an extension support fixed to, and extending from, the spindle of a chair for serving as a base for the arm support.

Still another feature of the present invention is the provision of a round disk having a smaller disk which is positioned in a stationary or fixed location relative to a chair, bracket, or object.

Still another feature of the present invention is the provision of a round disk engaged to the interior of a shroud having armrest where the arm support may be secured in a desired location by the application of downward force or weight upon the armrest which in turn causes a cantilever binding effect between the disk and shroud.

Still another feature of the present invention is the provision of a vertically adjustable stem or standard as integral or attached to the smaller disk to enable the height of the arm support to be adjusted relative to a chair, object, or bracket.

Still another feature of the present invention is the provision of a shroud having a cup-shaped armrest, disk-shaped armrest, or "T"-shaped armrest which is adapted to support the forearm or wrist of an individual during use of the arm support.

Still another feature of the present invention is the provision of an armrest which may be rotated or repositioned relative to the shroud.

An advantage of the present invention is that fatigue may be reduced for workers such as keyboard operators or assembly line personnel. One of the features contributing to this advantage is the repositionable shroud including the arm rest which may be moved to any location as desired by an individual. Another feature contributing to this advantage is the lack of deflection or tilt of the shroud or armrest even when leaned upon.

Another advantage is that the present invention may be mounted closer to the apparatus to be operated. The arm support may therefore occupy a minimal amount of space. One of the features contributing to this advantage is the provision of an elongate shroud between the armrest and the cantilever disk. Another contributing feature is the provision of only one arm between the armrest and the cantilever disk, or object.

Another advantage is that the present invention has a high load capacity. It easily supports a great amount of weight on the armrest such as the weight of a worker leaning on the armrest or pushing herself or himself up and out of a chair via the arm supports. One of the features contributing to this advantage is the provision of only one arm between the armrest and the cantilever disk or object. Another feature contributing to this advantage is the shroud which may handle heavy end loading.

Another advantage is that the present invention is ergonomic. The present arm support is flexible for positioning in any location as desired by an individual.

Another advantage is that the present invention may be connectable to objects such as chairs, tables, table tops, wheelchairs, or machines.

Another advantage is that the present invention may be mounted close to the surface of a table top without engaging or abrading the table top even when a great amount of leverage is exerted on the armrest.

Another advantage is that the present invention aids in relieving back, neck, and muscle fatigue associated with holding an arm in an extended position.

Another advantage is that the risk of carpal tunnel syndrome may be minimized. One feature contributing to this advantage is the relative stability provided by the armrest mounted on the shroud of the arm support, such that the forearm and wrist are maintained at the proper elevation relative to the hand.

Another advantage is that the shroud may be easily shortened or lengthened to accommodate varying work areas.

Another advantage is the provision of a shroud for enclosing a cantilever disk for protection of an individual and/or an individual's clothes from inadvertent pinching engagement to the shroud and/or cantilever disk.

DETAILED DESCRIPTION OF THE PREFERRED EMBODIMENTS

Figure 1:
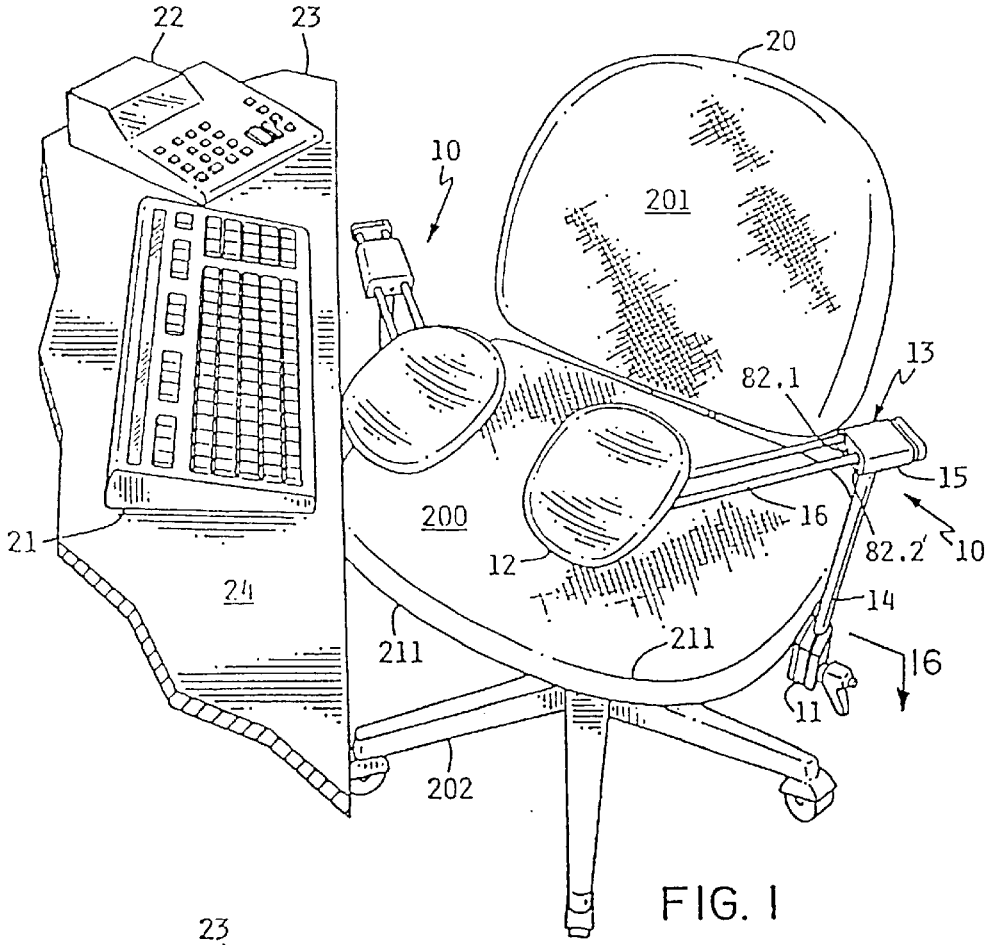
FIG. 1 is a perspective view of the present arm support mounted on a chair adjacent to a table with a keyboard and calculator.

As shown in FIG. 1, the present arm support is designated in general by the reference numeral 10 and includes as its principal components a base 11, an armrest 12, and a connection means 13 between the base 11 and the armrest 12. The connection means 13 includes a standard 14, a housing 15 with recirculating ball bearings, and a slide 16 slidable in the housing 15. The base 11 is connectable to a chair 20 via an elongate support affixed to the spindle of the chair 20. The armrests 12 engage and support the forearm and/or wrist for the operation of a keyboard 21 or calculator 22 which rest on a desk or table top 23 having a top surface 24.

Figure 2:
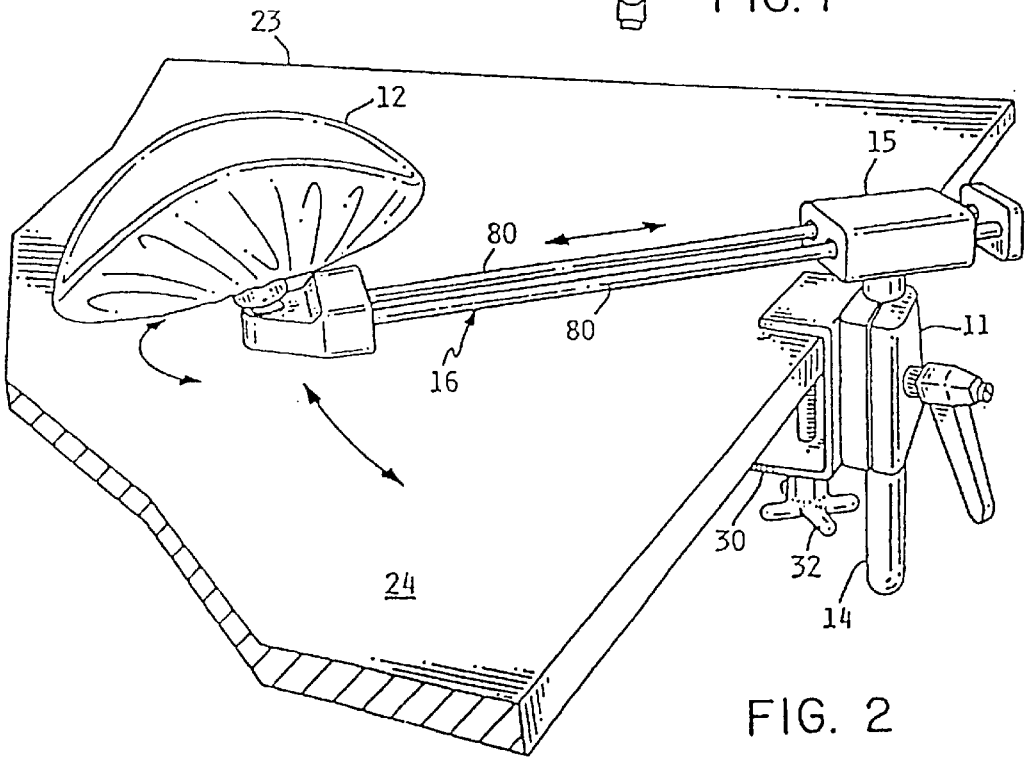
FIG. 2 is a perspective view of the arm support of FIG. 1 mounted on a table.
Figures 3, 4, 5:
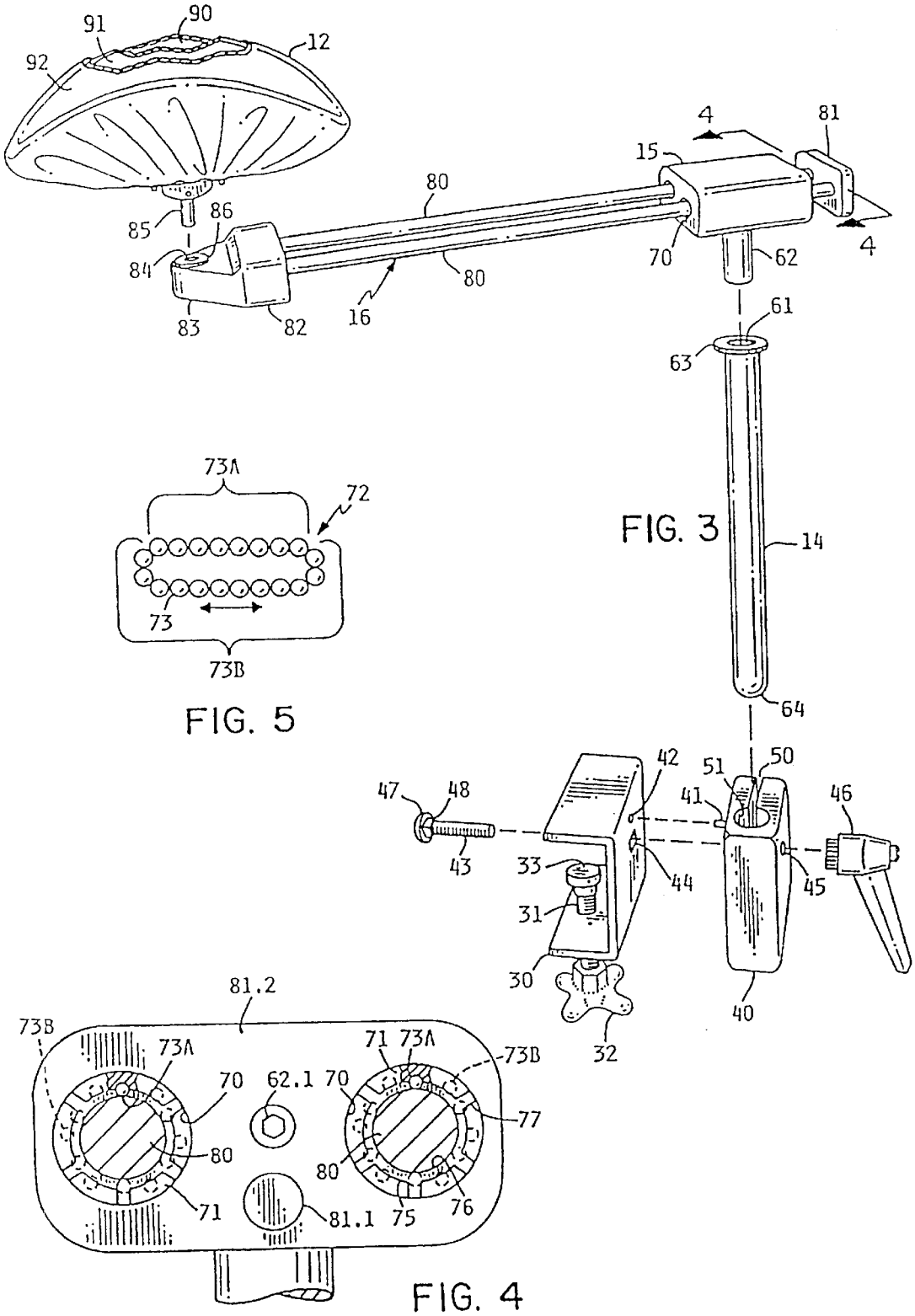
FIG. 3 is an exploded perspective view of the arm support of FIG. 2.
FIG. 4 is a section view at lines 4—4 of FIG. 3.
FIG. 5 is a diagrammatic view of a recirculating ball bearing circuit utilized in the arm support of FIGS. 1 and 2.

With more specificity, as shown in FIGS. 1, 2 and 3, the base 11 includes, if connectable to the desk 23, a generally U-shaped steel or aluminum clamp 30. The clamp 30 includes a threaded bolt 31 with a knob 32 fixed on one end and a pivotal and tiltable end piece 33 for engaging the underside of the desk top 23.

The base 11 further includes a slotted and apertured aluminum block 40 which is securable to the U-clamp 30. The block 40 includes a steel dowel pin or nub 41 for engaging an aperture 42 for alignment of block 40 relative to the U-clamp 30 and a threaded pin connector or carriage bolt 43 for being passed through respective apertures 44, 45 of the U-clamp and block 40, respectively, and engaging a threaded handle 46. The carriage bolt 43 includes a head 47 with a square portion 48 which locks into the inner portion of aperture 44 to prevent rotation of the pin connector 43 when tightened by the handle 46.

The block 40 further includes a vertical slot 50 communicating with a generally vertical standard-receiving hole 51. The aperture 45 and its respective carriage bolt 43 intersects the slot 50 such that the slot 50 is narrowed and the diameter of the apertures 51 is decreased when the handle 46 is tightened to squeeze the half portions of the block 40 together.

The connection means 13 includes the standard or post 14, which includes an axial seat 61 for seating a stem 62 depending from the housing 15. Seat 61 and stem 62 may be referred to as a joint. The stem 62 is fixed in a hole formed in the bottom of the housing 15 and is secured therein via a pin connector 62.1 as shown in FIG. 4. A flanged bushing 63 formed of a plastic with a low coefficient of friction such as TEFLON® or tetrafluoroethylene material is disposed in the seat 61 for engaging the stem 62 for a fluid-like swinging or pivoting of the housing 15 relative to the standard 14. The flanged portion of the bushing 63 typically fluidly engages the underside of the housing 15. The standard 14 is vertically adjustable in the base 11 by tightening or loosening the handle 46 to pinch or disengage the standard 14 from the standard-receiving hole 51. The standard 14 further includes a rounded closed bottom end 64. The stem 62 and standard 14 are typically formed of a cold rolled steel.

As shown in FIGS. 4 and 5, the housing 15, typically formed of aluminum, includes a pair of cylindrical parallel holes 70. Two or more cylindrical recirculating ball bearing steel sleeves 71 are fixed in each of the holes 70. Each of the sleeves 71 includes six oblong circuits 72 of recirculating balls 73. Balls 73A are load carrying balls in bearing contact between the sleeve 71 and the slide 16. Balls 73B are recirculating balls free to roll in clearance provided in the sleeves 71. The slide 16 which is carrying the load on the armrest 12 is rolled freely or fluidly along the load carrying balls 73A. The sleeves 71 include retainers which guide the balls 73 in the paths of the oblong circuits 72 to prevent the balls 73 from falling out such as when the slides 16 are removed from the sleeves 71 or such as when the sleeves 71 are removed from the housing 15.

As shown in FIG. 4, each of the sleeves 71 is fixed in its respective hole 70 via a locking washer 75 with an inner diameter 76 greater than the diameter of the rods 80 for avoiding friction between the rods 80 and washers 75. Each of the washers 75 includes a set of radial legs 77 for engaging the walls of the housing 15 which form the holes 70.

Figure 14:
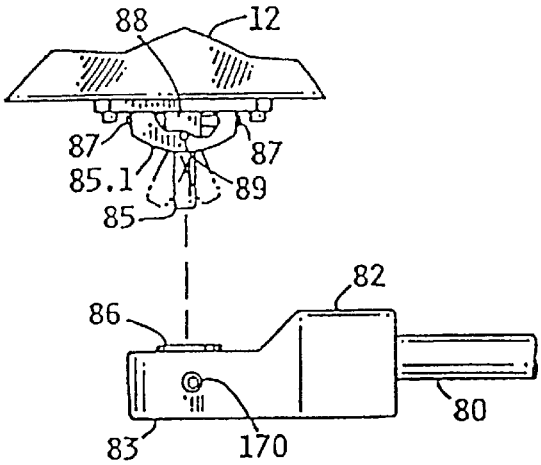
FIG. 14 shows means for tilting and locking the stem of the armrest of the arm support of FIGS. 1 and 2.

The slide 16 includes two steel linear rods 80 which actually engage the load-carrying balls 73A. The rods 80 may be stainless steel rods or be chrome-plated to prevent rust. The rods 80 are parallel to each other and spaced in such relation by a rear stop 81 and a front stop 82. The rear stop 81 is an aluminum plate fixed to and between the rear ends of the rods 80 and engages a resilient bumper 81.1 on the rear end 81.2 of the housing 15 to prevent a further sliding of the slide 16 in a forward direction. The front aluminum stop 82 is fixed to and between the front ends of the rods 80 and engages a resilient bumper 82.1 on the front end 82.2 of the housing 15 to prevent a further sliding of the slide 16 in a rearward direction. The front stop 82 includes an integral triangular platform 83 with a seat or aperture 84 for a stem 85 depending from a foundation 85.1 for the armrest 12. Seat 84 and stem 85 may be referred to as a joint. A flanged bushing 86 is disposed in the seat 84 to provide for a fluid pivoting of the stem 85 and armrest 12 relative to the seat 84 and slide 16. The bushing 86 is formed of a plastic with a low coefficient of friction such as TEFLON® or tetrafluoroethylene or material. A tilt to the arm rest 12 may be provided by adjusting the angle of the stem 85 relative to the armrest 12. Such a tilt is effectuated by loosening and tightening a pair of opposing pin connectors 87, as shown in FIG. 14, against an inner end 88 of the stem 85. Stem 85 includes a pivot 89 connected to the armrest foundation 85.1.

The armrest 12 includes a rigid aluminum curved or bowed plate 90 to which a closed cell foam padding 91 is affixed. A removable, washable fabric covering 92 overlays the cushioned plate 90 and padding 91. The plate 90 may be formed of plastic.

In operation, to install the arm support 10, the U-shaped clamp 30 is clamped to the desired position on the table top 23 by tightening the knob 32. The desired height for the armrest 12 or slide 16 relative to the top surface 24 is determined by orienting the standard 14 at the proper height by tightening the handle 46. The stem 62 of the slide 16 is then inserted in its seat 61 of the standard 14. The proper tilt of the stem 85 of the armrest 12 is set by turning the pin connectors 87. Subsequently the stem 85 of the armrest 12 is seated in its seat 84 to complete setup of the arm support 10.

For keying or other similar operations, a forearm and/or a wrist is placed on the armrest 12. While the forearm or wrist is on the armrest 12, the armrest 12 is swingable for 360° relative to the slide 16 via the stem 85 and seat 84; the armrest 12 is slidable to and away from the housing 15 via the slide 16; and the armrest 12 is swingable for 360° about the standard 14 via the stem 62 and seat 61. During such movements, the armrest 12 fluidly follows the lead of the forearm via the TEFLON® or tetrafluoroethylene material or bushing 86 between the stem 85 and seat 84, the recirculating balls 73 which engage the rods 80, and the TEFLON® or tetrafluoroethylene material or bushing 63 between the stem 62 and seat 61.

Figure 6:
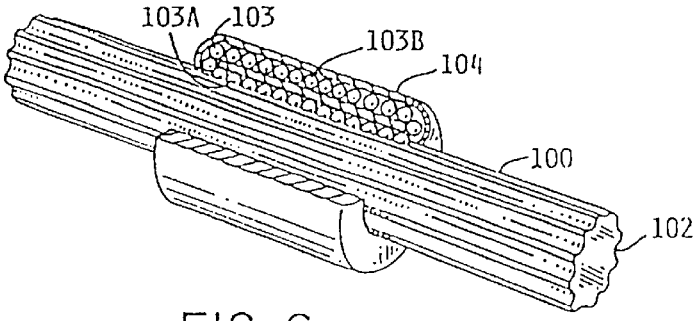
FIG. 6 is a perspective partial view of an alternate embodiment of the present arm support and shows a splined slide for engaging recirculating ball bearings to prevent rotation of the slide.
Figure 7:
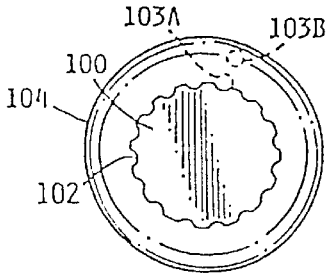
FIG. 7 is a section view of the alternate embodiment of FIG. 6.

As shown in FIGS. 6 and 7, in an alternate embodiment of the invention, an arm support may include only one rod or shaft slide 100. The rod or slide 100 includes a number of splines 102 or means for preventing rotation 102 of the slide 100. At least three of the splines 102 are engaged by recirculating balls 103 of a recirculating ball sleeve 104 to prevent rotation of the slide 100. Balls 103A are shown as engaging one of the splines 102; balls 103B are shown as recirculating in a circuit. In such an arrangement, although more than one slide 100 may be used for greater support, only one slide 100 is preferred to conserve space and weight. It should be noted that the provision of two rods 80 in the arm support 10 may also be referred to as a means for preventing rotation of the slide 16.

Figure 8:
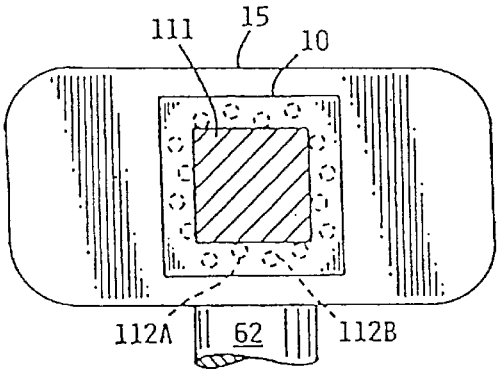
FIG. 8 is a section partial view of an alternate embodiment of the present arm support and shows a slide with a square cross section to prevent rotation of the slide.
Figure 9:
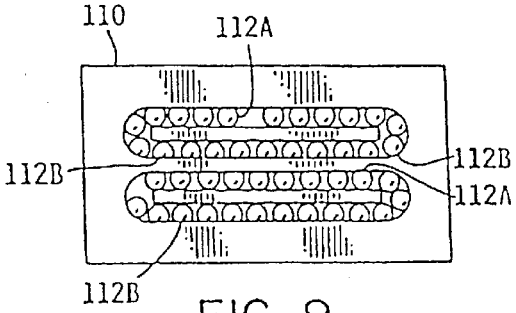
FIG. 9 is a section partial view of the alternate embodiment of FIG. 8 and illustrates recirculating ball bearing circuits.

As shown in FIGS. 8 and 9, in an alternate embodiment of the invention, the housing 15 includes a recirculating ball bearing sleeve 110 with a square cross section for engaging a rod or slide 111 with a square cross section. The recirculating ball bearing sleeve 110 includes recirculating balls 112 with balls 112A engaging the slide 111 and balls 112B being recirculated from engagement. Such a noncircular, squared shape of the sleeve 110 and slide 111 prevents rotation of the slide 111 and may be referred to as a means for preventing torque or rotation of the slide 111.

Figure 10:
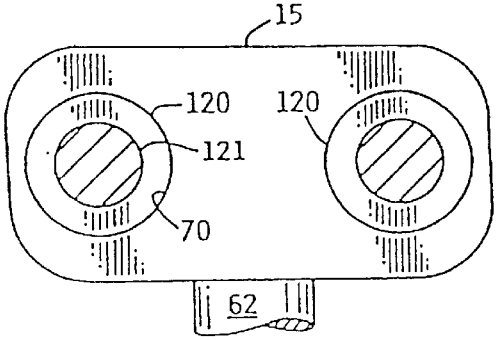
FIG. 10 is a section, partial view of an alternate embodiment of the present arm support and shows a slide engaging a ceramic pillow block or sleeve with a low coefficient of friction.

As shown in FIG. 10, in another alternate embodiment of the invention, the housing 15 includes a pair of cylindrical pillow blocks or sleeves 120 engaging the pair of rods 80 for forming a slide. The sleeves 120 are formed of a ceramic with a low coefficient of friction such as FRELON® and are fixed in the holes 70 of the housing 15.

Figure 11:
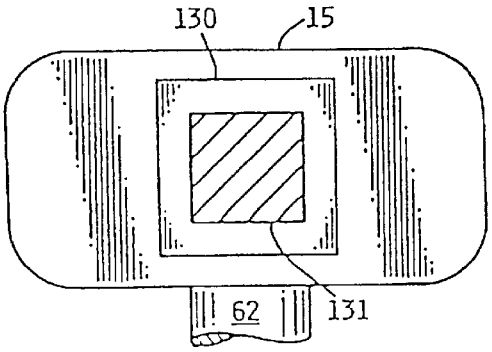
FIG. 11 is a section, partial view of an alternate embodiment of the present arm support and shows a slide with a square cross section engaging a ceramic pillow block or sleeve with a low coefficient of friction.

As shown in FIG. 11, in another alternate embodiment of the invention, the housing 15 includes a sleeve or pillow block 130 which is formed of a ceramic with a low coefficient of friction such as FRELON®. The sleeve or pillow block 130 is square in cross section for engaging a rod or slide 131 square in cross section to prevent rotation of the rod 131. As with sleeve 120, sleeve 130 is fixed in the housing 15.

Figure 12:
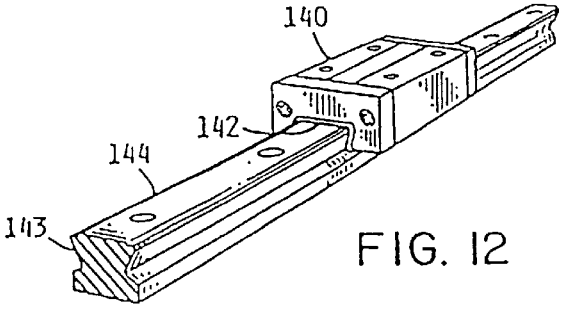
FIG. 12 is a section, partial view of an alternate embodiment of the present arm support and shows a slide engaging recirculating ball bearings in a track formed in a housing.

As shown in FIG. 12, in another alternate embodiment of the invention, a housing such as the housing 15 may include a block 140. The block 140 includes a dovetailed track 142 with recirculating ball bearings. A dovetailed portion 143 of a slide or rail 144 engages the recirculating ball bearings of the dovetailed track 142 for mounting the armrest 12.

Figure 13:
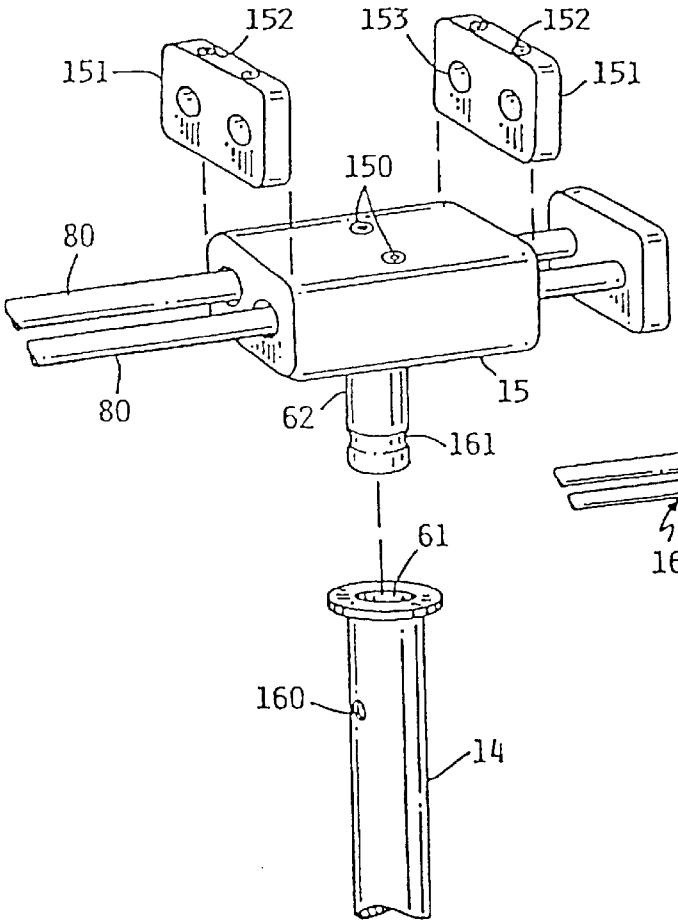
FIG. 13 is an exploded view showing slide restrictions for the arm support of FIGS. 1 and 2.

As shown in FIG. 13, in an alternate embodiment of the invention, the housing 15 may have various means for at least partially limiting or restricting or locking sliding of the slide 16. Such means includes a pair of threaded pin connectors 150 in the base 15 for being tightened against the rods 80. Such means may also include removable end stops 151 with pin connectors 152 for engaging the rods 80. For locking the slide 16 at a particular location for locating the armrest 12 at a particular location, both of the end stops 151 may be utilized. For shortening or lengthening the effective sliding of the slide 16, one of the end stops 151 is utilized. One of the end stops 151 is placed on the slide 16 by removing front or rear stop 81 or 82 which is fixed to the slide 16 via set screws or pin connectors, and then sliding the end stop 151 on to the slide 16 via apertures 153. The end stop 151 is then fixed to the slide 16 via pin connectors or set screws 152. As the slide 16 is used to shorten or lengthen the stroke of the slide 16, it may be referred to as means for controlling or adjusting the length of the stroke of the slide. Also as shown in FIG. 13, the standard 14 may include a means for limiting or restricting or locking pivoting of the stem 62 relative to the standard 14. Such means may include a pin connector 160 for engaging an annular groove 161 formed on the stem 62. Such an engagement also prevents inadvertent removal of the stem 62 from the seat 61. As shown in FIG. 14, in an alternate embodiment of the invention, the slide 16 may include means for limiting or restricting or locking pivoting of the armrest 12 relative to the slide 16. Such means may include a pin connector 170 in the triangular platform 83 of the slide 16 for engaging the stem 85.

Figure 15:
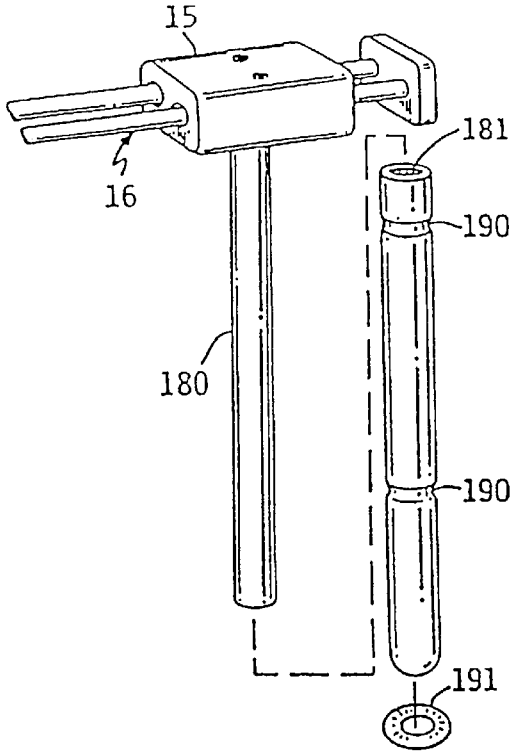
FIG. 15 shows an alternate standard for the arm support of FIGS. 1 and 2.

As shown in FIG. 15, in an alternate embodiment of the invention, an elongate stem 180 replaces the shorter stem 62. The seat 181 is formed to a greater depth in the standard 14 to accommodate the longer stem 180. The longer stem 180 and seat 181 are precision formed and may include a lubrication such as a TEFLON® or tetrafluoroethylene material or grease to provide for a fluid pivoting between the stem 180 and seat 181. The lubrication or grease may include molybdenum disulfide. An advantage of the longer stem 180 is that it may minimize a tilting or deflection of the housing 15 and slide 16 such that the triangular platform end piece 83 is less likely to scrape against the surface 24 of the table 23 when the armrest 12 is supporting a relatively great amount of weight. In other words, with a longer stem 180, the slide 16 is more likely to remain parallel to the table surface 24. Accordingly, the housing 15 and slide 16 may be mounted closer to the table surface 24. It should further be noted that the stems 62, 180 may be replaced by a needle bearing.

As also shown in FIG. 15, in alternate embodiment of the invention, the standard 14 may include annular seats 190 for seating an O-ring or safety washer or stop 191 for preventing the standard 14 from falling to the floor when the handle 46 is loosened to widen the diameter of the standard receiving hole 51 to release the standard 14. If the standard receiving hole 51 is so widened and the standard 14 slips downwardly, the safety washer 191 prevents the standard 14 from falling out of the block 40 by engaging the top of the block 40.

As shown in FIG. 1 and FIGS. 16–18, the chair 20 includes a seat or seat pan 200, a back support 201, and a set of legs 202. The seat 200 is fixed to a spindle 203 which pivots in a bushing 204, which in turn is fixed to the legs 202. In an alternate embodiment of the invention, a pair of elongate supports 205 are fixed to the spindle 203 for pivoting with the seat 200 and back support 201. Each of the elongate supports 205 includes a bar formed in generally the shape of an "L" with a proximal end 206 and a bent distal end 207. Apertures 208 are formed in each of the proximal ends 206 of each of the elongate supports 205 for receiving the threaded ends of a pair of U-bolts 209 for fixing the elongate supports 205 to each other and to the spindle 203 via locking nuts 210. The effective length of each of the elongate supports 205 relative to a periphery 211 of the chair seat 200 is adjustable via the plurality of apertures 208. The block or base portion 40 is connectable to the distal end 207 which includes apertures 213, 214 identical in orientation to respective apertures 42, 44 of U-clamp 30 for engaging pins 41 and carriage bolt 43. As an alternative to the plurality of apertures 208, the elongate supports 205 may include slots 215 for engaging U-bolts 209. Accordingly, the arm support 10 rotates with the seat pan 200 via the elongate support 205, which is fixed to the spindle 203 with no drilling or damage thereto.

Figure 17:
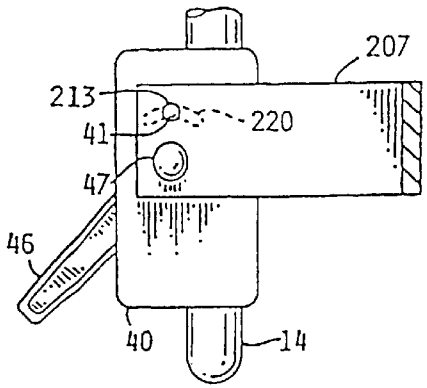
FIG. 17 is a section view at lines 17—17 of FIG. 16.

In an alternate embodiment of the invention, as shown in FIG. 17, a groove 220 may be formed in the face of distal end 207 which confronts the block 40. In this embodiment the dowel pin 41 is shortened to a nub and the aperture 42 is eliminated to be replaced by the groove 220. The groove 220 is curved radially about aperture 214 and includes an undulating floor to define certain seats for the nub. Accordingly, the standard 14, the slide 16 and the armrest 12 are tiltable relative to the block 40 by being pivotal about carriage bolt connector 43. Such a groove 220 may also be formed in the surface of the U-clamp confronting the block 40.

Figure 19:
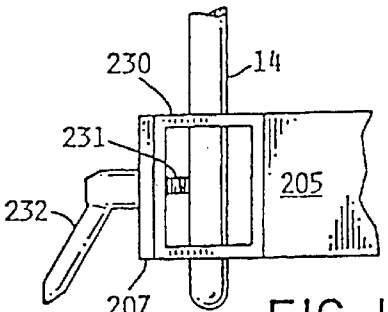
FIG. 19 is a front elevation view of an alternate embodiment of a base fixed to the elongate support of FIG. 16.

It should be further noted, as shown in FIG. 19, that instead of the block 40, the elongate support 205 may include a tubular member 230 affixed to the inner side of end 207. The tubular member 230 engages apertures formed in tubular member 230 and is engaged by a male pin connector 231 of a handle 232. The pin connector 231 is threadably engaged with the end 207 and one side of the tubular member 230. Accordingly, the standard 14 is adjustable in height in the tubular member 230.

Figure 16:
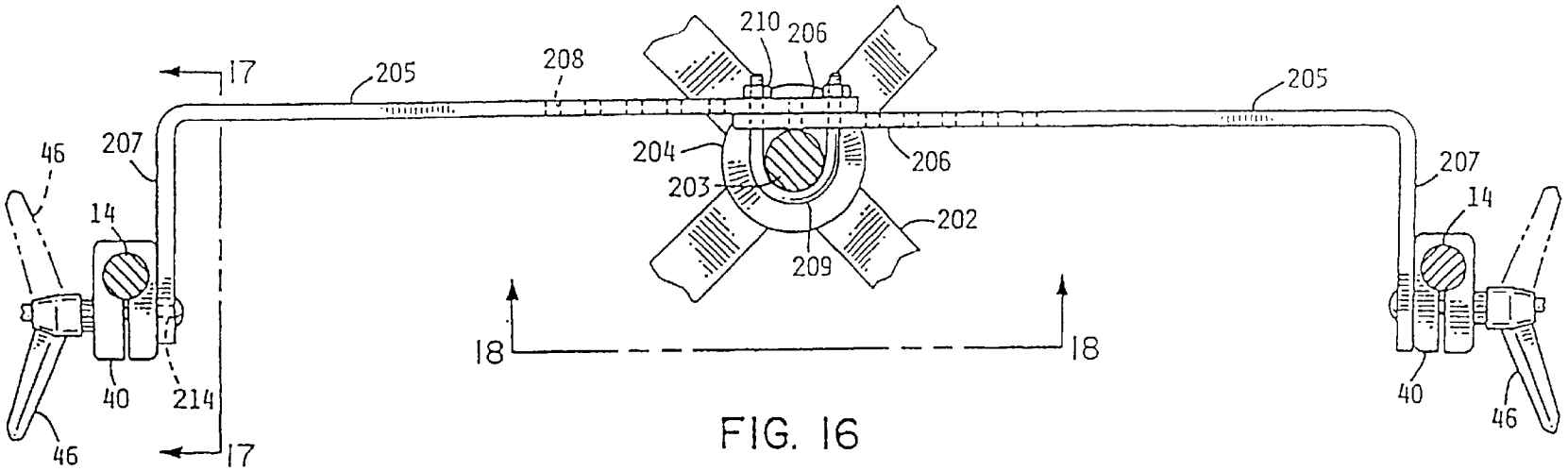
FIG. 16 shows a section view at lines 16—16 of FIG. 1 to illustrate an elongate support for fixing the present arm support to the spindle of a chair.
Figure 18:
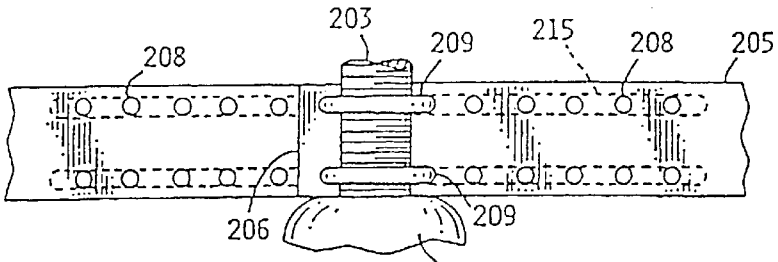
FIG. 18 is a section view at lines 18—18 of FIG. 16.

It should be noted that the handle 46 may be of a spring-loaded type such that the handle 46 may be oriented in a different position without a further tightening or disengagement of the standard 14 from the block 40. FIG. 16 shows such relative orientation of the handle 46 to, for example, move the handle 46 to an out-of-the way position to prevent inadvertent bumping of the handle 46.

In an alternative embodiment, a pillow block 250 preferably includes an interior and exterior. The pillow block 250 may be formed of one piece, or may be split at the preference of an individual in two pieces. If a split pillow block 250 is selected, as see in FIG. 23C, preferably at least two tightening means 252 having springs 254 are provided. The tightening means 252 preferably engage both portions of the split pillow block 250. The tightening means 252 may be manipulated for adjustment of the level of engagement between the rods 80, or linear slides 16, and the roller bearing means 256. If more friction is desired between the rods 80, or linear slides 16, and the roller bearing means 256, then the tightening means 252 may be rotated in a clockwise direction, for reduction of the fluid relationship between the rods 80, or linear slides 16, and the pillow block 250. If less friction is desired, the tightening means 252 may be incrementally released for facilitating the fluid relationship between the rods 80, or linear slides 16, and the roller bearing means 256. The clockwise rotation of the tightening means 252 squeezes the portions of the pillow block 250 together, which in turn squeezes the rods 80 against the roller bearing means 256. The fluid motion of the arm support 10 within the pillow bock 250 is thereby reduced. A spring 254 preferably encircles each tightening means 252. The spring 254 provides for the incremental adjustment of the engagement between the portions of the pillow block 250 and the rods 80 or linear slides 16. It should be noted that the tightening means 252 may be omitted at the preference of an individual.

The pillow block 250 preferably includes a front face 258 and a rear face 260. In the preferred embodiment, at least two apertures traverse the front face 258. The apertures through the front face 258 are preferably adapted for receiving engagement of the rods 80 or linear slides 16. In addition, the rear face 260 preferably includes at least two apertures which are longitudinally aligned to the apertures through the front face 258. The apertures through the rear face 260 are preferably adapted for receiving engagement of the rods 80 or linear slides 16. It should be noted that the apertures through the front face 258 and rear face 260 are preferably aligned so that the rods 80, or linear slides 16, are substantially parallel within the pillow block 250.

Figure 20:
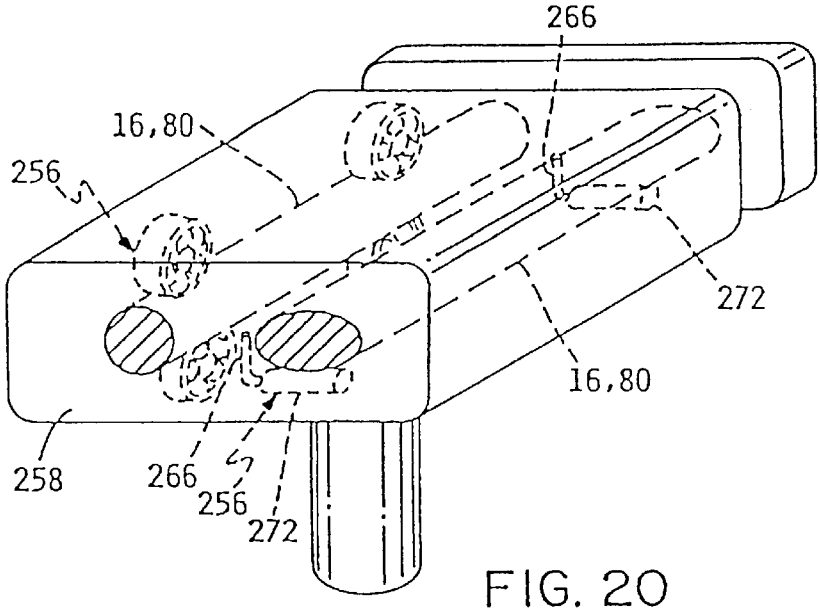
FIG. 20 is a partial phantom line perspective view of the pillow block including alternative embodiments of the roller bearing means.
Figure 21:
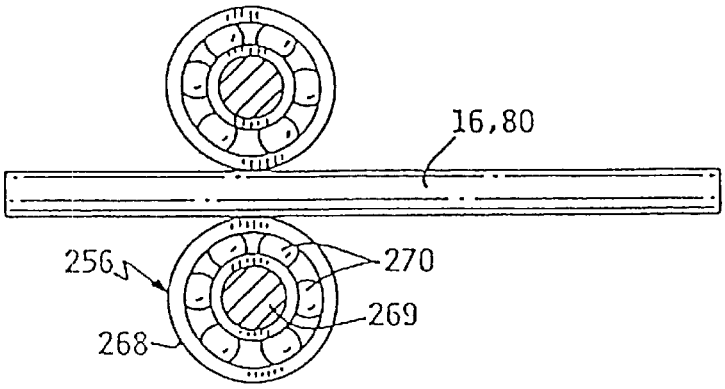
FIG. 21 is a detail end view of a container of the roller bearing means.
Figure 22:
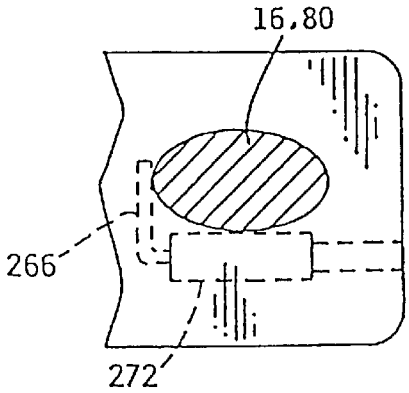
FIG. 22 is a cross sectional end view taken along the line 22—22 of FIG. 20 showing an oval linear slide and alternative roller bearing means.
Figure 24:
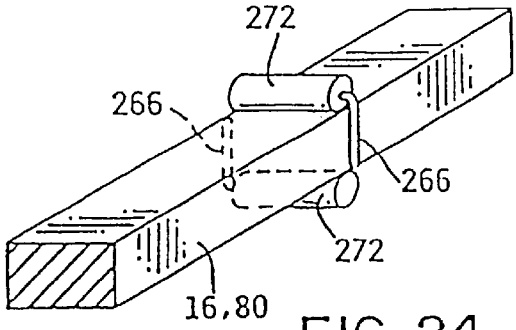
FIG. 24 is a partial perspective view of a square linear slide and alternative roller bearing means.

As seen in FIGS. 20 and 24, the rods 80, or linear slides 16, may have any cross-sectional shape as preferred by an individual including, but not limited to, circular, oval and/or square. It should be noted that the performance of the arm support device 10 is not affected by the cross sectional shape selected for the rods 80 or linear slides 16. Alternative roller bearing means 256 may be selected for engagement to either circular, oval, or square cross-sectional shaped rods 80, or linear slides 16, at the preference of an individual provided that the essential functions, features, and attributes described herein are not sacrificed.

Figure 25:
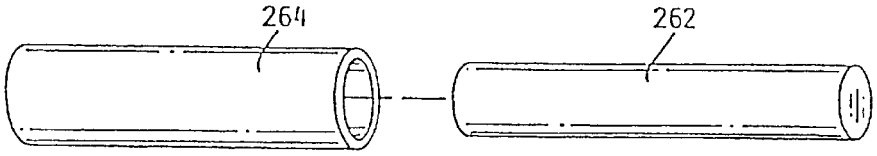
FIG. 25 is a partial exploded view of an alternative roller bearing means of FIGS. 22 and 24.
Figure 26:
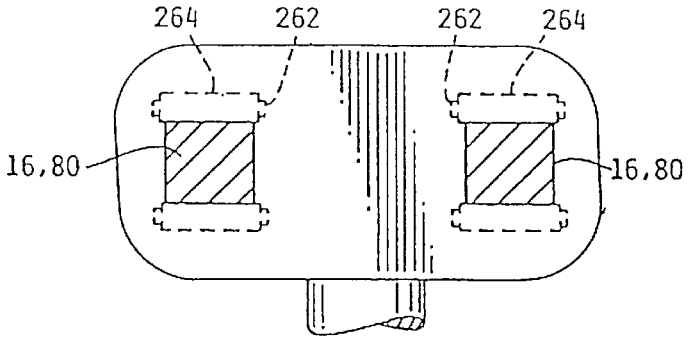
FIG. 26 is an end view, partial phantom line view of a square slide as seen in FIG. 24.
Figure 27:
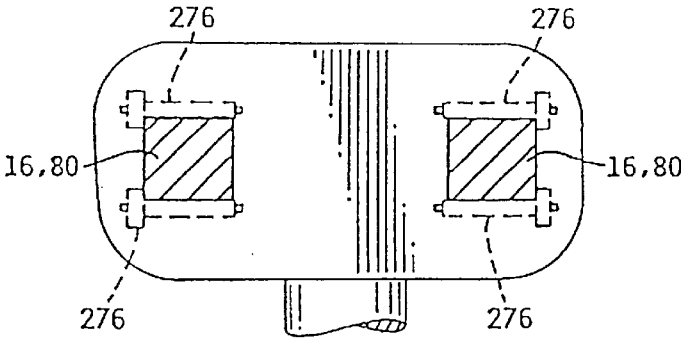
FIG. 27 is a cross sectional end view of the invention showing a circular linear slide and alternative roller bearing means.

The roller bearing means 256 preferably engage the rods 80 within the interior of the pillow block 250. In the simplest embodiment, the roller bearing means 256 include a solid shaft 262 which is surrounded by a hollow tubular collar 264. (FIGS. 25 and 26) The hollow tubular collar 264 is the portion of the roller bearing means 256 which engages the rods 80, or linear slides 16, within the interior of the pillow block 250. In this embodiment, the solid shaft 262 is preferably rigidly affixed to, and extends inward from, the interior walls of the pillow block 250, for engagement below and above each of the rods 80 or linear slides 16. (FIGS. 23, 24, and 27).

A guide ledge 266 is preferably affixed to, and extends perpendicularly from, each of the solid shafts 262, and is positioned proximal to a lateral side of a rod 80 or linear slide 16. The guide ledges 266 function to retain the rods 80 in a position for engagement to the roller bearing means 256 during use of the arm support device 10. The guide ledges 266 function to prevent the slippage or lateral movement of the rods 80, or linear slides 16, within the pillow block 250, such that engagement to the roller bearing means 256 is terminated.

The engagement of the rods 80, or linear slides 16, to the hollow tubular collar 264, functions as a means for providing fluid motion of the rods 80 within the pillow block 250. Engagement between the hollow tubular collar 264 and the solid shaft 262 is preferably of reduced friction. The friction between the hollow tubular collar 264 and the solid shaft 262 may be minimized by the selection of friction reducing materials such as TEFLON® or tetrafluoroethylene material or polyethylene materials. In this embodiment, the material selected for the solid shaft 262, and hollow tubular collar 264, facilitates the rotation of the hollow tubular collar 264 in the either a clockwise or counterclockwise direction about the solid shaft 262. In this embodiment, a square or oval shaped rod 80, or linear slide 16, is preferably used in the arm support device 10. The guide ledges 266 preferably extend vertically upwards or downwards from the solid shaft 262 for engagement to the lateral side of a rod 80 or linear slide 16.

Figure 23A:
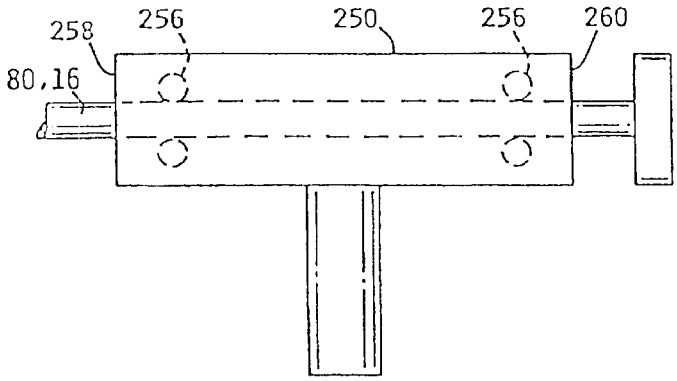
FIG. 23A is a detail side view, partial phantom line view of the pillow block showing alternative roller bearing means.
Figure 23B:
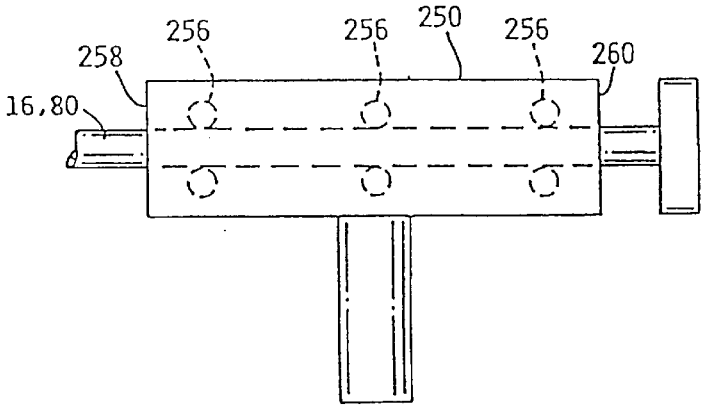
FIG. 23B is a detail side view, partial phantom line view of the pillow block showing alternative roller bearing means.
Figure 23C:
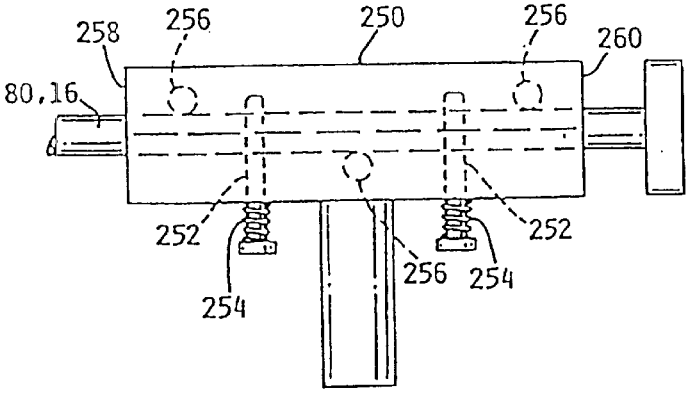
FIG. 23C is a detail side view, partial phantom line view of the pillow block showing alternative roller bearing means.

A plurality of roller bearing means 256 are positioned above and below each of the rods 80, within the interior of the pillow block 250. As seen in FIGS. 23A, 23B, and 23C, the arrangement of the roller bearing means 256 may vary considerably at the discretion of an individual. As depicted in FIG. 23A, a roller bearing means 256 is positioned above and below each of the rods 80 proximal to the front face 258. Additional roller bearing means 256 are positioned above and below each of the rods 80 proximal to the rear face 260. As depicted in FIG. 23B, the plurality of roller bearing means 256 are equally spaced above and below each of the rods 80 within the interior of the pillow block 250. As depicted in FIG. 23C, a roller bearing means 256 is positioned above each of the rods 80 proximal to the front face 258 and rear face 260, and a single roller bearing means 256 is positioned centrally below each of the rods 80 within the interior of the pillow block 250. It should be noted that any desired combination of roller bearing means 256 may be used above or below the rods 80, or linear slides 16, at the preference of an individual provided that a sufficient number of roller bearing means 256 are used to facilitate and support a fluid range of motion the arm support device 10.

Figure 28:
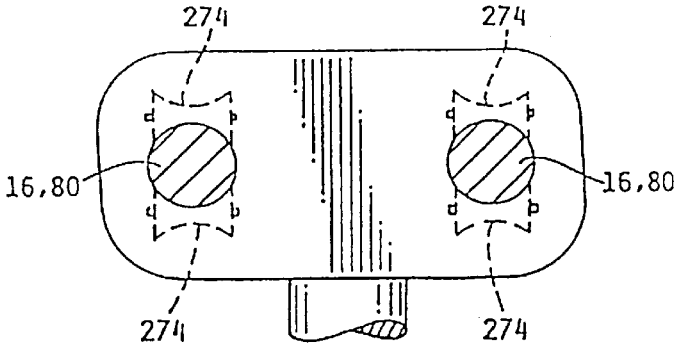
FIG. 28 is a cross sectional end view of the invention showing a circular linear slide and alternative roller bearing means.
Figure 29:
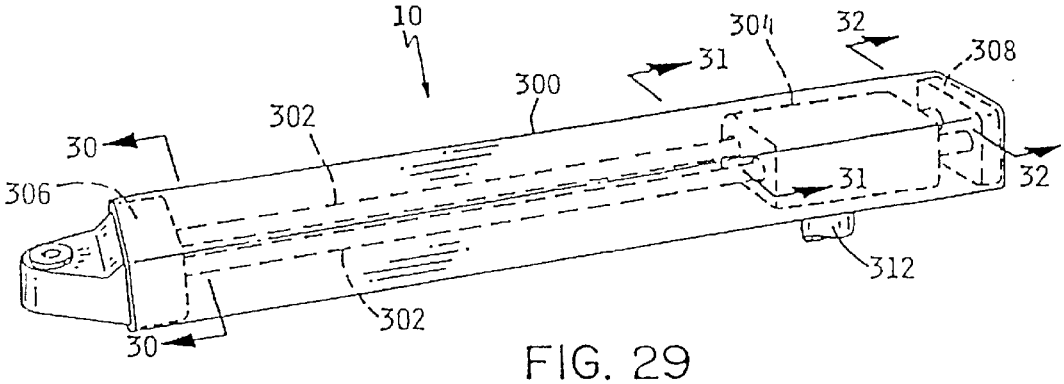
FIG. 29 is an environmental view of a shroud engaged to the arm support of FIG. 1.
Figure 30:
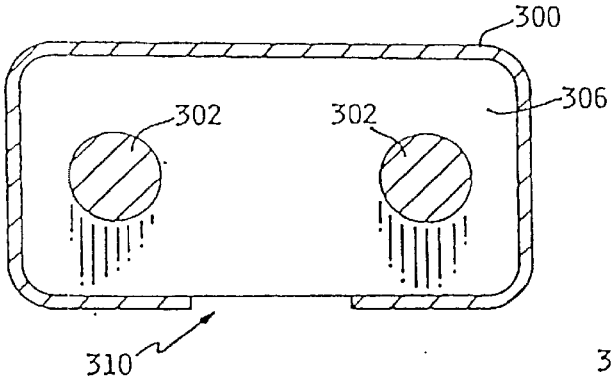
FIG. 30 is a cross-sectional side view taken along line 30—30 of FIG. 29.
Figure 31:
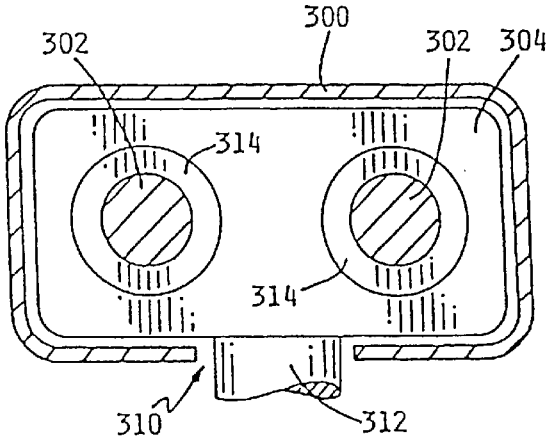
FIG. 31 is a cross-sectional side view taken along line 31—31 of FIG. 29.
Figure 32:
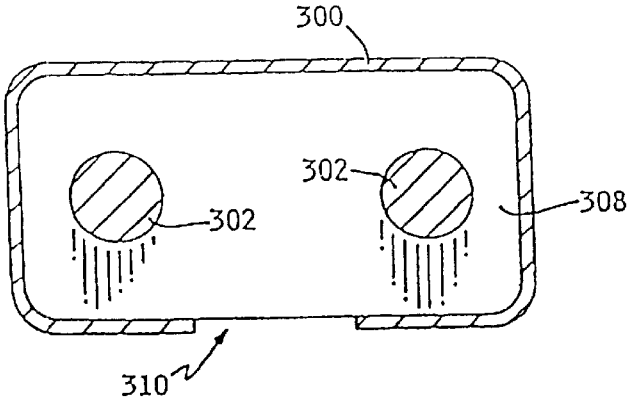
FIG. 32 is a cross-sectional side view taken along line 32—32 of FIG. 29.
Figure 31A:
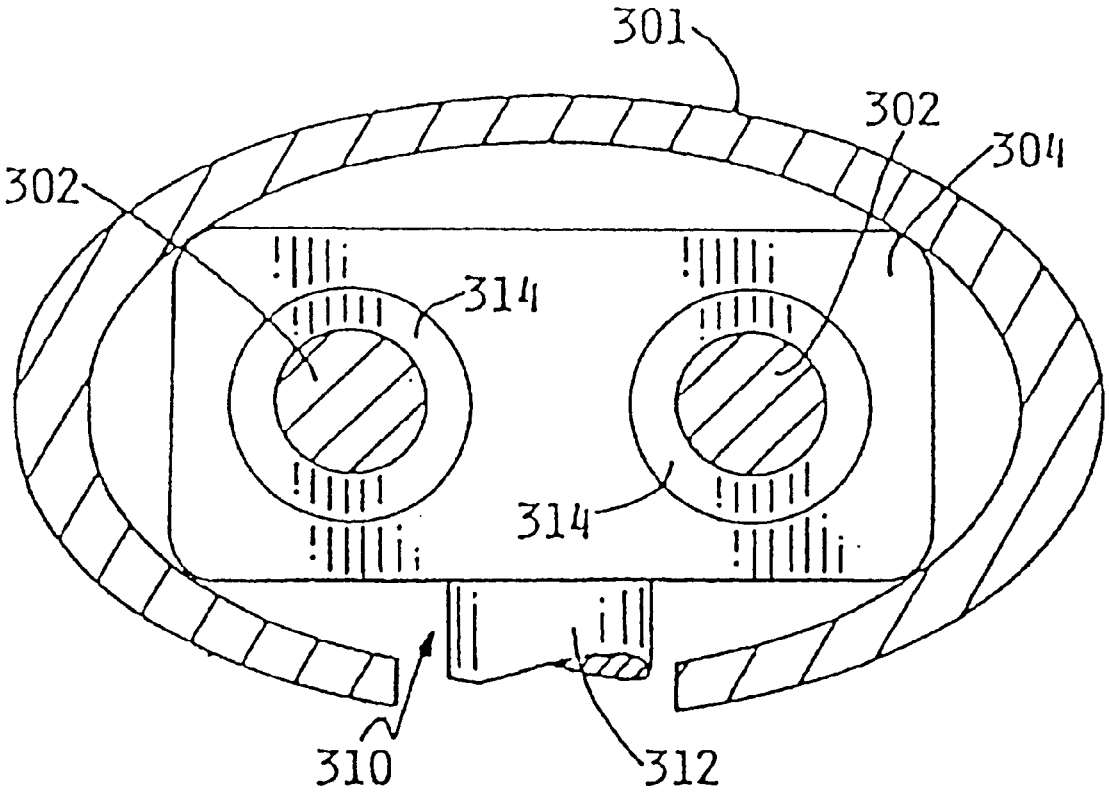
Figure 33:
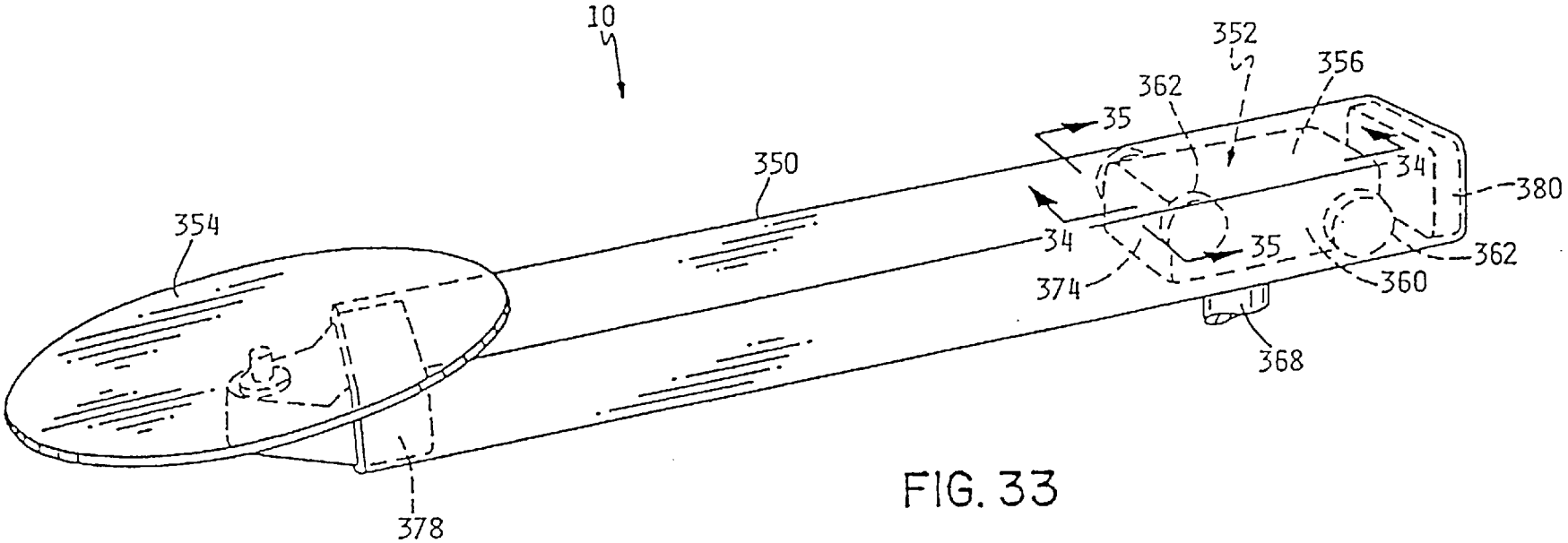
FIG. 33 is an environmental, partial phantom line view of an alternative embodiment of the invention.

In another embodiment, the roller bearing means 256 include a container 268 confining a plurality of ball bearings 270. The containers 268 preferably encircles a rod 80 within the interior of the pillow block 250. It should be noted that a container 268, confining a plurality of ball bearings 270, is preferably located proximal to the front face 258, and to the rear face 260, within the interior of the pillow block 250. Each container 268 preferably encircles one of the rods 80 or linear slides 16. Each container 268 preferably has an internal diameter dimension of sufficient size to confine, and position the plurality of ball bearings 270 into an encircling arrangement around a rod 80. In this embodiment, any cross sectional shape may be selected for the rods 80 at the preference of an individual including, but not limited to, square, circular, or oval. It should be noted that a container 268 may be of any preferred shape including, but not limited to, circular, square, and/or oval at the discretion of an individual for use with a particular shape of rod 80. The containers 268, and ball bearings 270, preferably provide for the fluid forward or rearward movement of the rods 80, within the pillow block 250, during use of the arm support device 10. It should be noted that each of the containers 268 of ball bearings 270 is preferably affixed to the interior of the pillow block 250. It should also be noted that the use of guide ledges 266 is not necessary due to the encircling of the rods 80 by the roller bearing means 256. In an alternative embodiment, as depicted in FIG. 28, the roller bearing means 256 includes a plurality of rollers 272, where each roller has internal bearings and an arcuate receiving surface 274. The arcuate receiving surface 274 is adapted for flush and continuous engagement to the rods 80 or linear slides 16. In this embodiment, a roller 272 is preferably positioned above and below each of the rods 80, such that the arcuate receiving surfaces 274 interface to flushly confine the rods 80 within the interior of the pillow block 250. In this embodiment, the necessity of the use of guide ledges 266 is eliminated due to the substantially encircling relationship of the arcuate receiving surfaces 274 around each of the rods 80. The rollers 272 thereby function to flushly engage and confine the motion of the rods 80 to a forward or rearward direction within the pillow block 250. The rollers 272 are preferably aligned within, and are affixed to, the interior of the pillow block 250, for positioning of the rods 80 through the apertures traversing the front face 258 and rear face 260.

An alternative roller bearing means 256 is depicted in FIG. 27 showing the use of flanged rollers 276 having internal bearings. The flanged rollers 276 incorporate the features of the rollers 272, and the guide ledges 266, into a single mechanism. The flanged rollers 276 are preferably positioned within, and are affixed to the interior of, the pillow block 250 such that the flanged portion of each roller 276 is positioned proximal to a side wall. The flanged rollers 276 are preferably used in conjunction with a rod 80 having a square cross-sectional shape as seen in FIG. 27. In this embodiment, a plurality of flanged rollers 276 are positioned above and below each of the rods 80, supporting the fluid motion for the arm support device 10. The number of flange rollers 276 used in the arm support device 10 may vary considerably at the preference of an individual. In the preferred embodiment, four and eight flanged rollers 276 are used to support each rod 80. It should be noted that a sufficient number of flanged rollers 276 are required above and below each of the rods 80 to facilitate the sliding fluid engagement within the pillow block 250 during use of the arm support device 10. In this embodiment, the flanged portion of the rollers 276 are preferably positioned to the exterior of the rods 80. It should be noted that an individual may position the flanged portion of a roller 276 on any side of a rod at his/her discretion provided that the non-flanged surface of each roller 276 supports a rod 80 during use of the arm support device 10. An individual may alternate the positioning of the flanged portions of the rollers 276 to the interior or the exterior of the rods 80 at his or her discretion. The flanged rollers 276 function to confine the position of the rods 80 within the pillow block 250 for elimination of the guide ledges 266. The flanged rollers 276 preferably function to confine the rods 80 for "straight-line" forward or rearward fluid motion within the pillow block 250.

In an alternative embodiment of the invention as depicted in FIGS. 29–32, a shroud 300 is provided for covering of the linear slide 302, pillow block 304, front stop 306, and rear stop 308. The shroud 300 is generally elongate and includes a slot 310. The slot 310 is disposed adjacent to a stem 312 which is adapted to be engaged to a standard as previously described. The slot 310 is adapted for permitting the passing engagement of the stem 312 during movement of the linear slide 302 with respect to the pillow block 304.

The shroud 300 includes a substantially oval cross-sectional shape. The cross-sectional shape for the shroud 300 may be varied considerably at the discretion of an individual. The shroud 300 preferably has a length dimension sufficient to engage the front stop 306, and rear stop 308 of the arm support 10. The shroud 300 may also be formed of extruded aluminum material. The material selected for the shroud 300 may be varied considerably at the discretion of an individual provided that the essential functions, features, and attributes described herein are not sacrificed. It should be noted that the shroud 300 may be formed of any material having sufficient strength to not fracture, bend, or fail during use of the arm support 10 by an individual.

The shroud 300 may be attached to the front stop 306 and to the rear stop 308 by machine pressing. The shroud 300 may alternatively be attached by any affixation means including but not limited to the use of screws, adhesives, welding, or bolts and nuts. The shroud 300 preferably encircles, but is not engaged to, the pillow block 304. The shroud 300 is thereby permitted to freely slide with respect to the position of the pillow block 304 in any direction as desired by an individual. (FIG. 31) It should be noted that the shroud 300 does not interfere with the sliding engagement between the linear slides 302 and the pillow block 304.

A purpose and function of the shroud 300 is to reduce the exposure and introduction of dust and dirt into the roller bearing means/ball bearing arrangements 314, enclosed with in the pillow block 304 as engaged to the linear slides 302. The reduction of contaminants into the pillow block 304 and roller bearing means/ball bearing arrangements 314 significantly improves the operation and useful life of the arm support 10. It should also be noted that the necessity for maintenance of the arm support 10 is thereby significantly reduced. An additional purpose of the shroud 300 is to minimize the risk of an individual's clothes and/or arm from being pinched between the linear slide 302 and the pillow block 304 during use of the arm support device 10.

In an alternative embodiment of the invention as depicted in FIGS. 33–39, a shroud 350 replaces the linear slides as previously described. In this embodiment a pillow block 352 engages the shroud 350 for the provision of the slidable motion of the arm rest 354 of the arm support 10.

In this embodiment, the pillow block 352 includes a first upper surface 356, a first lower surface 358, and a pair of opposite surfaces 360 which extend vertically between the first upper surface 356 and the first lower surface 358. In this embodiment, the roller bearing means 362 are engaged to the pair of opposite surfaces 360 via supports 364 and to the shroud 350. The roller bearing means 362 may be affixed to the pillow block 352 by any preferred means as selected by an individual, examples of which have been previously described. In this embodiment, the roller bearing means 362 is referenced to in general terms and may be comprised of: freely rotatable disks affixed to a pillow block 352 by an axle formed of a screw or pin where the roller disks either include or do not include bearings; a recirculating ball bearing arrangement; a linear bearing arrangement; or a roller bearing arrangement as earlier described. It should be noted that any of the above-described freely rotatable disks, recirculating ball bearing arrangements, linear bearing arrangements, or roller bearing arrangements may be freely substituted to function as the roller bearing means 362 at the discretion of an individual.

The pillow block 352 includes an aperture 366. The aperture 366 is adapted for receiving engagement of a set screw which affixes the pillow block 352 to the stem 368. (FIGS. 34–39) The engagement between the set screw, aperture 366, stem 368, and pillow block 352 prevents rotation between the stem 368 and pillow block 352. It should be noted that swingable rotation of the pillow block 352 is provided by the engagement of the stem 368 to the standard as earlier described. The other features and functions of the roller bearing means 362 and pillow block 352, including but not limited to the engagement to objects, vertical adjustment, and motion, are identical to the features and functions as earlier described.

A plurality of roller bearing means 362, including the alternative embodiments as earlier described are affixed to the pillow block 352. The roller bearing means 362 may be a freely rotatable disk 370 confining a plurality of ball bearings 372. As may be seen in FIGS. 34–39, a plurality of disks 370 may be positioned proximate to both the first upper surface 356 and first lower surface 358 of the pillow block 352. It should be noted that at least two disks 370 are engaged to the pillow block 352 proximate to the front face 374 and to the rear face 376. Each disk 370 preferably engages the shroud 350. Each disk 370 preferably has an internal diameter dimension of sufficient size to encircle a support 364 having sufficient strength to affix the roller bearing means 362 to the pillow block 352. Each support 364 may be affixed to, and extend perpendicularly outward from, one of the pair of opposite surfaces 360 of the pillow block 352. The fluid rotation of each disk 370 about the supports 364 provides for the fluid motion of the shroud 350 with respect to the pillow block 352. It should be noted that the cross-sectional shape selected for the supports 364 may include, but are not limited to, square, circular, or oval. It should also be noted that the disks 370 preferably have a circular shape. The disks 370, and ball bearings 372 preferably provide for the fluid forward or rearward movement of the shroud 350 as engaged to the pillow block 352 during use of the arm support device 10.

In an alternative embodiment, the roller bearing means 362 may additionally include a plurality of rollers where each roller has internal bearings and a shroud engaging surface. The shroud engaging surface is preferably adapted for flush and continuous engagement to the interior of the shroud 350. In this embodiment, a pair of rollers are preferably positioned proximate to each of the first upper surface 356 and first lower surface 358. In an alternative embodiment, the roller bearing means 362 may additionally include the use of flanged rollers having internal bearings.

Figure 34:
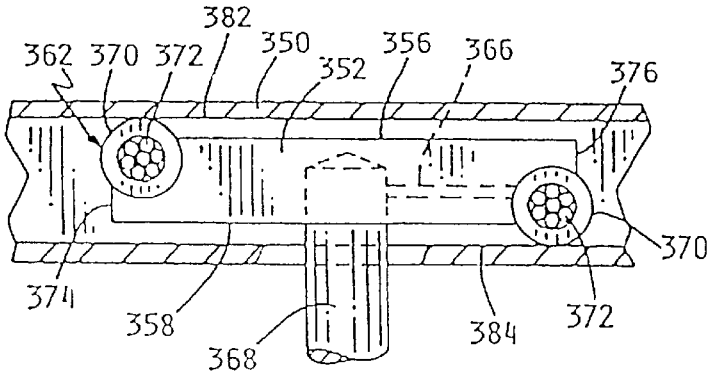
FIG. 34 is a partial cross-sectional side view of an alternate embodiment of the shroud and pillow block taken along line 34—34 of FIG. 33.
Figure 35:
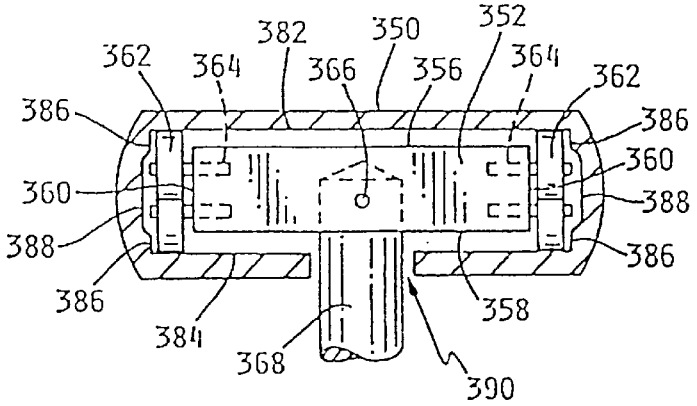
FIG. 35 is a cross-sectional side view of the invention taken along the line 35—35 of FIG. 33.
Figure 36:
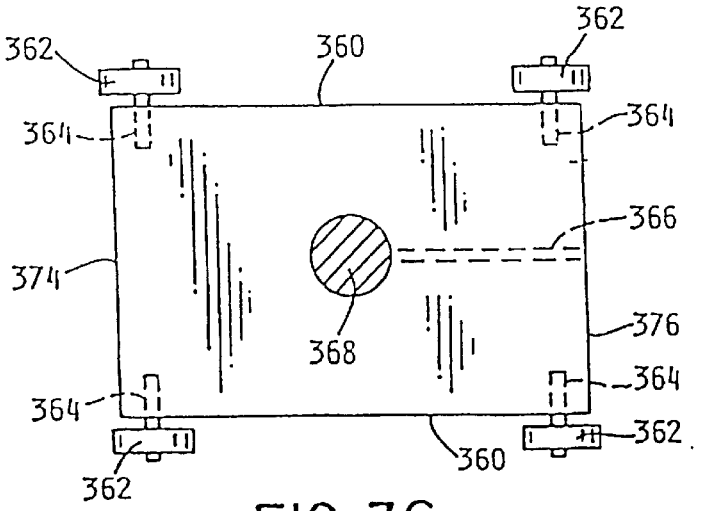
FIG. 36 is a partial top view of an alternate pillow block as depicted in FIGS. 33 and 34.
Figure 37:
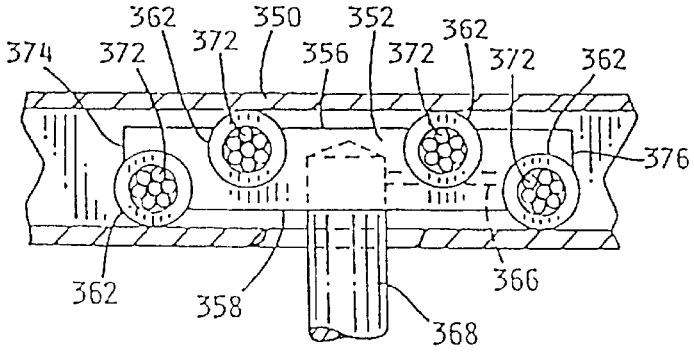
FIG. 37 is an alternate partial cross-sectional side view taken along line 34—34 of FIG. 33.
Figure 38:
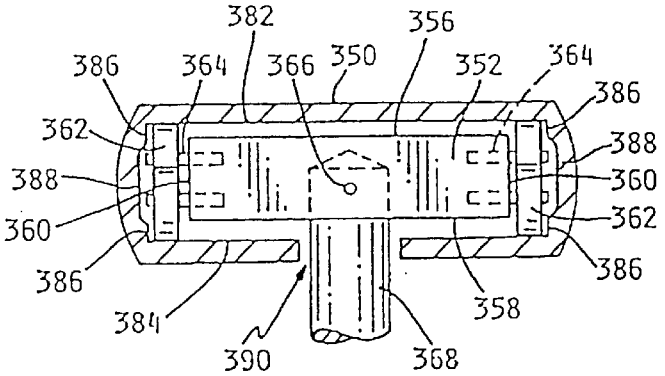
FIG. 38 is an alternate partial cross-sectional end view taken along line 35—35 of FIG. 33.
Figure 39:
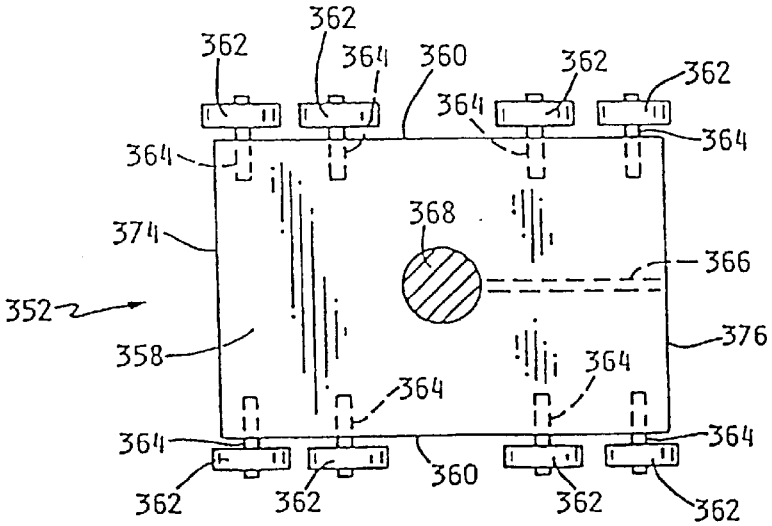
FIG. 39 is an alternate top view of the pillow block depicted in FIGS. 36 and 37.

As may be seen in FIGS. 34–36, a pair of disks 370 or roller bearing means 362 are preferably attached to the pair of opposite surfaces 360 of the pillow block 352 proximate to the first upper surface 356 and the front face 374. An additional pair of disks 370 or roller bearing means 362 are preferably affixed to the pair of opposite surfaces 360 proximate to the rear face 374 and the first lower surface 358. The position and/or combination of disks 370 or roller bearing means 362 as depicted in FIGS. 34–36 may be suitably varied at the discretion of an individual. As depicted in FIGS. 37–39, two pairs of disks 370 or roller bearing means 362 are preferably affixed to the pair of opposite surfaces 360, where one pair is proximate to the front face 374, one pair is proximate to the rear face 376, and both pairs are proximate to the first lower surface 358. An additional two pairs of disks 370 or roller bearing means 362 are affixed to the pair of opposite surfaces 360 of the pillow block 352 proximate to the stem 368 and the first upper surface 356. It should be noted that any combination and location of disks 370 or roller bearing means 362 may be selected by an individual for attachment to the pillow block 352 provided that the essential functions, features, and attributes described herein are not sacrificed.

Figure 40:
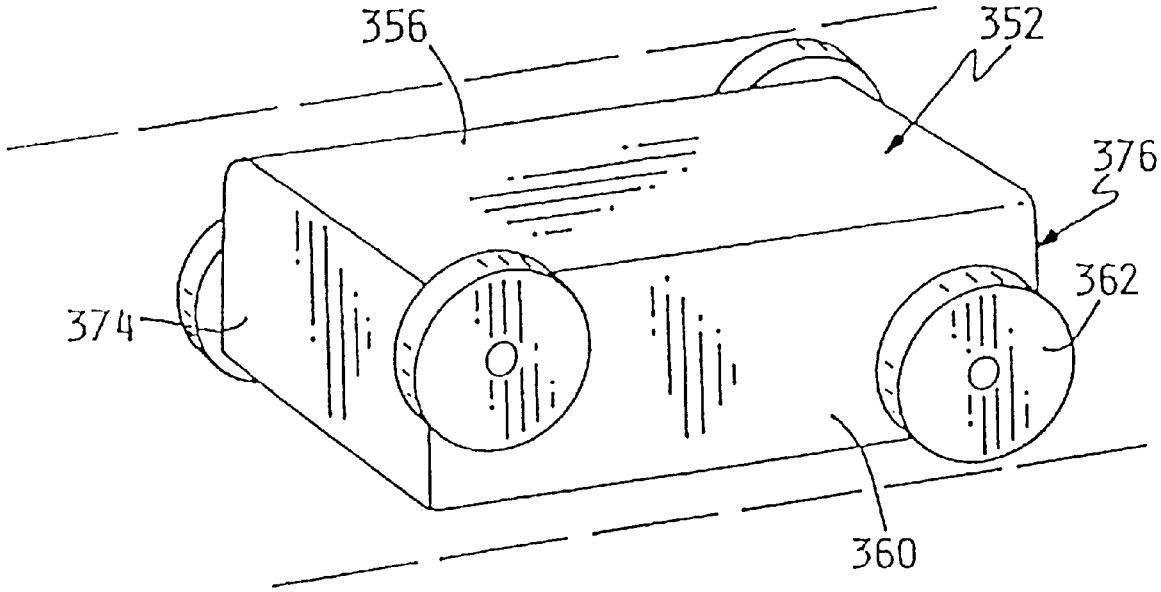
FIG. 40 is an alternative detailed isometric partial phantom line view of a pillow block including roller bearing means positioned at opposite corners.
Figure 41:
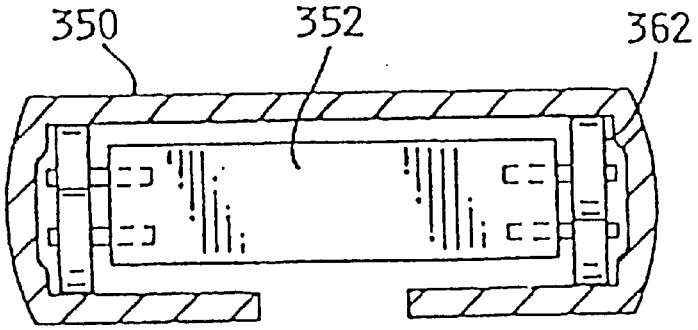
FIG. 41 is an alternative partial cross-sectional end view taken along line 35—35 of FIG. 33.
Figure 42:
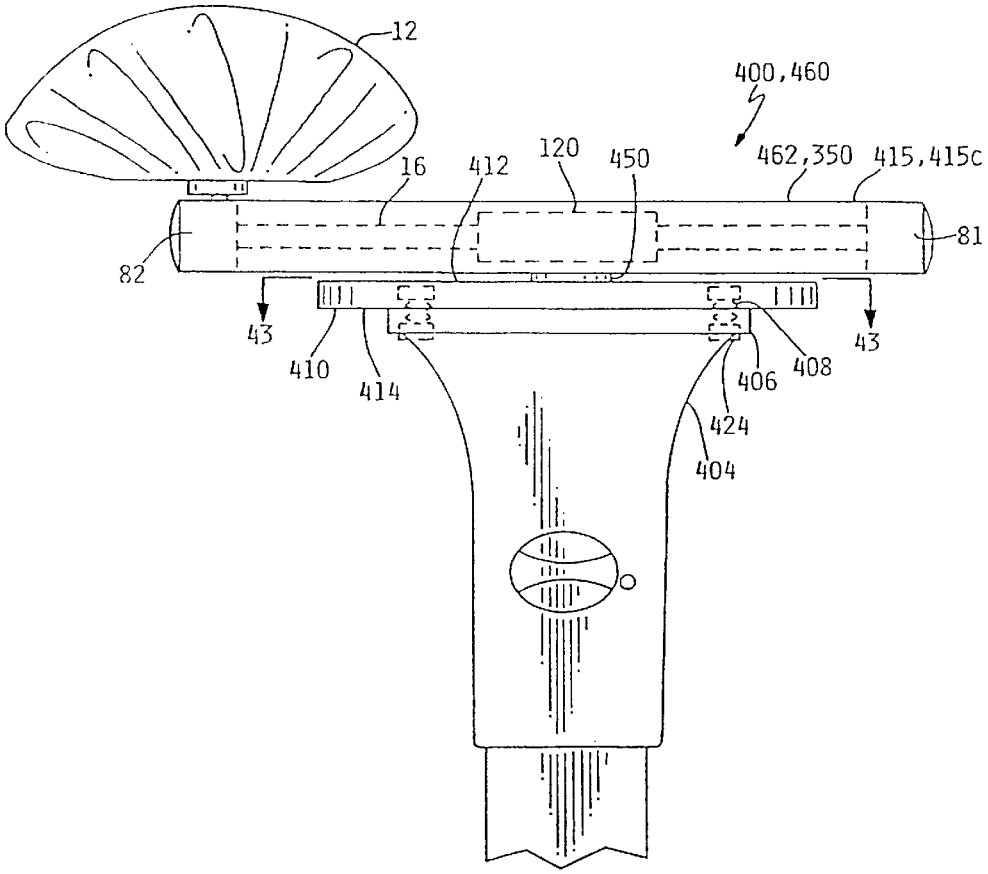
FIG. 42 is a side elevation view of a combination device of the ergonomic arm support and bracket invention with some internal structure shown in phantom.
Figure 43:
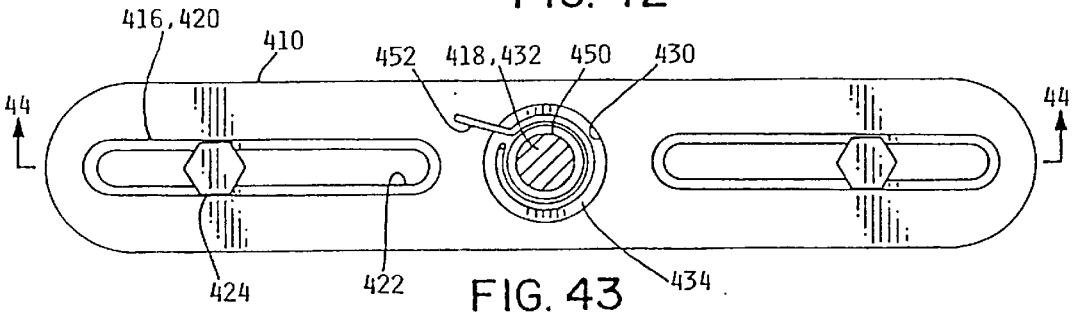
FIG. 43 is a cross-sectional view of a combination device of the ergonomic arm support and bracket invention taken along the lines 43—43 of FIG. 42.
Figure 44:
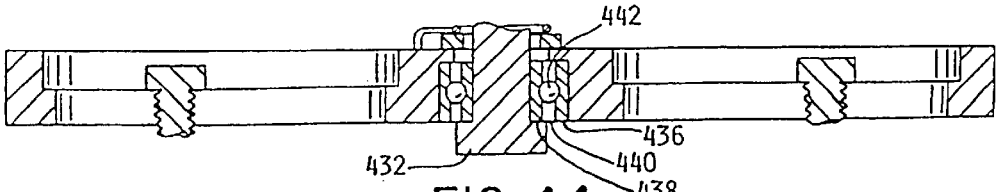
FIG. 44 is a cross-sectional view of a combination device of the ergonomic arm support and bracket invention taken along the lines 44—44 in FIG. 43.
Figure 45:
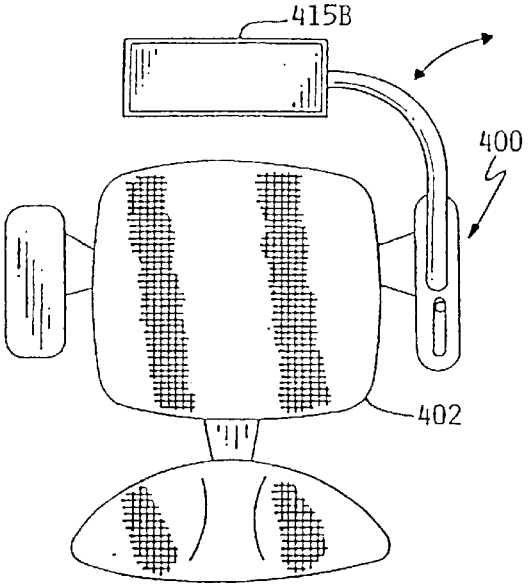
FIG. 45 is a top elevation view of a combination device of the ergonomic arm support and bracket invention with a tray attached as an appendage.
Figure 48:
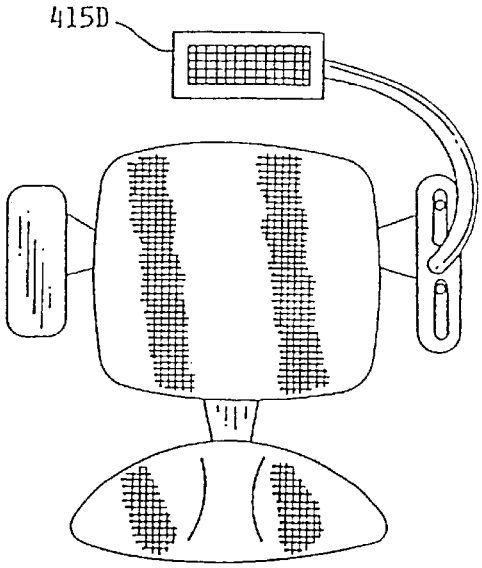
FIG. 48 is a top elevation view of a combination device of the ergonomic arm support and bracket invention with a stenographic machine attached as an appendage.
Figure 46:
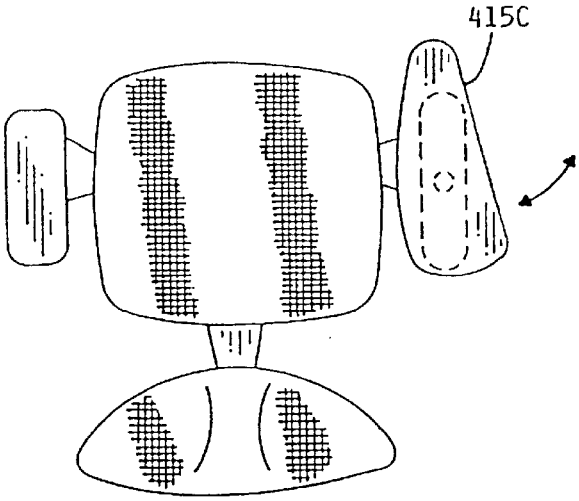
FIG. 46 is a top elevation view of a combination device of the ergonomic arm support and bracket invention with an ergonomic arm support attached as an appendage.
Figure 47:
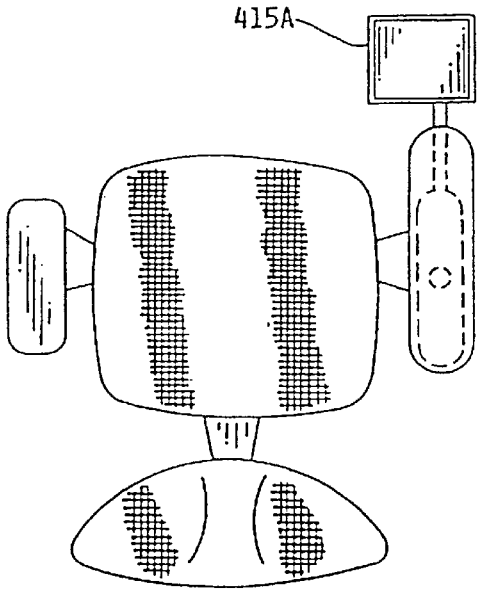
FIG. 47 is a top elevation view of a combination device of the ergonomic arm support and bracket invention with a mouse pad attached as an appendage.
Figure 49:
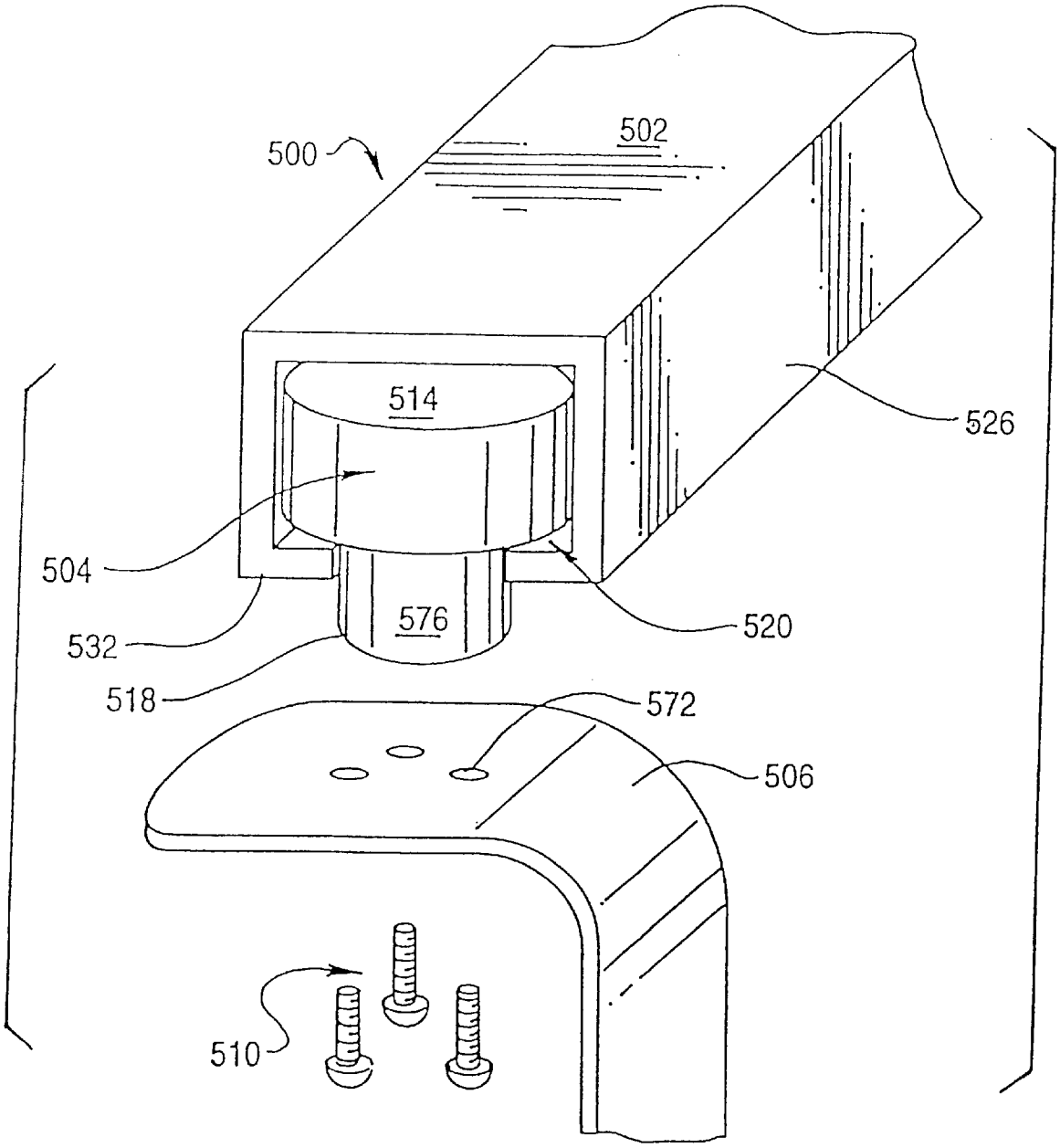
FIG. 49 is a partial isometric exploded detailed view of the shroud and cantilever disk as may be connectable to an object.

As may be seen in FIGS. 40 and 41, a pair of disks 370 or roller bearing means 362 are preferably affixed to the opposite surfaces 360 proximate to opposite corners of a pillow block 352 and are further proximate to the first upper surface 356. In addition, a second pair of disks 370 or roller bearing means 362 are preferably affixed to the opposite surfaces 360 proximate to the two remaining opposite corners of the pillow block 352, and are further proximate to the first lower surface 358. The disks 370 or roller bearing means 362 mounted to a pillow block 352 in this configuration engage the interior of a shroud 350 permitting free sliding engagement therebetween regardless of the upward or downward pressure or load being exerted upon, or applied to, the arm rest 354.

It should also be noted that any preferred number of roller bearing means 362 or disks 370 may be selected as preferred by an individual for the provision of the fluid sliding motion between the shroud 350 and the pillow block 352.

The elongate shroud 350 preferably encloses the pillow block 352. The shroud 350 preferably includes a front stop 378 and a rear stop 380. The front stop 378 and rear stop 380 may be integral, or may be affixed to, the shroud 350 as preferred by an individual. It should be noted that any means may be selected by an individual to attach the front stop 378 and rear stop 380 to the shroud 350 including but not limited to the use of machine pressing, welding, screws, adhesives, and or nuts and bolts provided that separation therefrom does not occur during use of the arm support device 10. The shroud 350 preferably also includes an interior top surface 382, an interior bottom surface 384, and an interior pair of side surfaces 386 extending between the interior top surface 382 and the interior bottom surface 384. Each of the interior pair of side surfaces 386 preferably include a longitudinally extending and centrally positioned roller bearing means receiving channel 388 which is adapted to receive roller bearing means 362. The engagement between the roller bearing means 362 and the roller bearing means receiving channels 388 prevent axial rotation of the shroud 350 with respect to the pillow block 352. The roller bearing means receiving channels 388 are preferably positioned adjacent and proximate to the opposite side surfaces 360 of the pillow block 352.

The interior bottom surface 388 preferably includes a centrally positioned and longitudinally extending slot 390. The slot 390 is preferably adapted for passing engagement of the stem 368 during fluid linear motion of the shroud 350 with respect to the pillow block 352. The stem 368 is preferably swingably connected to a standard and base as previously described permitting the pillow block 352 to be swingable and vertically adjustable relative to the base of the arm support device 10.

In this embodiment, the shroud 350 substantially covers the pillow block 352 extending from a position proximate to the front stop 378 to the rear stop 380. The rear stop 380 is preferably positioned rearwardly of the pillow block 352. (FIG. 33) The shroud 350 is preferably formed of extruded aluminum material. The shroud 350 may, however, be formed of any other sturdy material as preferred by of an individual, including but not limited to the use of metals or plastics, provided that fracture or failure does not occur during use of the arm rest 354. The shroud 350 preferably has a cross-sectional shape of an oval. The cross-sectional shape of the shroud 350 may, however, be square or round at the preference of an individual.

The remaining features and functions of the roller bearing means 362 and/or ball bearing arrangements as engaged to the pillow block 352 are preferably identical to the embodiments as earlier described with the exception of the elimination of the necessity of ledges or guides 266 as earlier described.

The shroud 350 is preferably affixed to the pillow block 352 by the positioning of the roller bearing means 362 within the roller bearing means receiving channels 388. Additionally, the interior bottom surface 384, including the slot 390, prevents vertical raising of the shroud 350 with respect to the pillow block 352. The shroud 350 may be machine pressed for engagement to the front stop 378 and rear stop 380 which positions the shroud 350 in a substantially covering relationship over the pillow block 352. Axial rotation of the shroud 350 with respect to the pillow block 352 is thereby prevented. The vertical separation of the shroud 350 from the pillow block 352 is prevented by the engagement between the roller bearing means 362 within the roller bearing means receiving channels 388 and the engagement between the interior bottom surface 384 and the first lower surface 358.

The shroud 350 preferably minimizes the accumulation and/or presence of dust or dirt contamination proximate to the roller bearing means 362. In addition, the shroud 350 preferably minimizes the risk of an individual's clothes and/or arm from being pinched between the roller bearing means 362, pillow block 352, and/or a linear slide as earlier described during use of the arm support device 10. The use of the shroud 350 preferably eliminates the necessity of linear slides or rods 16, 80 as previously described, significantly improving the utility of an arm support device 10 to an individual.

In this embodiment it should be noted that the arm rest 354 may be substantially round in shape including the rotational and tilt functions as earlier described. In addition, the ball bearing arrangement/roller bearing means 362 may be freely substituted at the discretion of an individual to provide for the free flowing linear movement of the shroud 350 with respect to the pillow block 352.

The present invention may also include an ergonomic arm support and bracket device 400 for use with a chair 402, as seen in FIGS. 42–48.

The ergonomic arm support and bracket device 400 preferably includes a chair arm support 404 having a substantially horizontal chair arm mounting surface 406. The chair arm mounting surface 406 preferably has a plurality of holes 408 therethrough for attaching a chair arm or standard arm pad (not shown). The chair arm mounting surface 406 is well known in the art as a standard item for attaching chair arms.

The ergonomic arm support and bracket device 400 also preferably include a bracket 410 having a top surface 412 and a bottom surface 414. The bracket 410 preferably includes a means 416 for mating to the mounting surface 406. More generally, the bracket 410 may be described as having a means 420 for mounting to an object. The bracket 410 may be rectangular, square, or oval in shape, as preferred for engagement to the chair mounting surface 406. The bracket 410 may be formed of any suitable and sturdy material as preferred by an individual, including, but not limited to, the use of metals, and plastics. The bracket 410 preferably functions as a universal-type affixation mechanism for attachment of an ergonomic arm support device to the arm mounting surface 406 of a standard chair. The bracket 410 preferably enables an ergonomic arm support device to be quickly and easily affixed to a standard chair by an individual.

The bracket 410 also preferably includes a means 418 for attaching an appendage 415 to the bracket 410.

The means 416 for mating to the mounting surface 406 or means 420 for mounting to an object preferably comprises a plurality of slots 422 in the bracket 410 which is adapted for receiving engagement of connectors 424 therethrough. The connectors 424 may alternatively comprise either the means 416 for mating or the means 420 for mounting and may be referred to interchangeably therewith. The connectors 424 preferably engage the holes 408 through the mounting surface 406. The connectors 424 are preferably slidably engaged with the slots 422 to allow for the removable and adjustable positioning of the bracket 410 relative to the mounting surface 406 or other object. The connectors 424 may preferably be bolts, but may also be pins, screws or other suitable connectors. Alternatively, the means 416 for mating or means 420 for mounting may be comprised of a series of aligned and regularly spaced apertures through the bracket 410 which may be suitably adapted for alignment with the holes 408 through the mounting surface 406. In this embodiment, a pin, screw, or bolt may be suitably engaged through the aligned apertures and holes 408 during removable and adjustable affixation of the bracket 410 to the mounting surface 406. Alternatively, the bracket 410 may be permanently attached to the mounting surface 406 by the use of either standard or self-tapping screws or any other affixation means including, but not limited to, the use of adhesives and/or solder or welding. Preferably, the connectors 424 are recessed in the slots 422.

The means 418 for attaching an appendage 415 to the bracket 410 preferably comprises an aperture 430 in the bracket 410 and an attachment bolt 432 therethrough, the attachment bolt 432 may suitably engage the appendage 415.

The means 418 for attaching an appendage 415 may also include a bearing device 434 positioned in the aperture 430, where the attachment bolt 432 may engage the bearing device 434 thereby allowing pivotal motion of the attachment bolt 432 within the aperture 430. The bearing device 434 may also include an outer race 436 having an external diameter substantially equal to the diameter of the aperture 430, an inner race 438 engaging the attachment bolt 432, a channel 440 between the outer race 436 and inner race 438, and a plurality of ball bearings 442 disposed in the channel 440. The outer race 436 may be frictionally press-fit into the aperture 430 and the inner race 438 may be frictionally engaged with the attachment bolt 432. The ball bearings 442 allow the outer race 436 to rotate freely about the inner race 438, thus allowing the appendage 415 to rotate freely about the bracket 410.

The means 418 for attaching an appendage 415 may further include a spacer 450 engaging the bracket 410 and separating the bracket 410 from the appendage 415, thereby allowing free rotation of the appendage 415 about the bracket 410. The spacer 450 may preferably surround the attachment bolt 432.

The means 418 for attaching an appendage 415 may preferably include a return spring 452 about the spacer 450, the return spring 452 connecting the bracket 410 to the appendage 415, thereby urging the appendage 415 into alignment with the bracket 410. In this way, when the appendage 415 is moved out of alignment with the bracket 410, the appendage 415 will return to alignment with the bracket 410 when released.

The object to which the bracket 410 may be attached may preferably be a chair arm support 404.

The appendage 415 which may be attached to the bracket 410 may be a mouse pad 415A, a tray 415B, an ergonomic arm support 415C, a stenographic machine 415D, or other suitable appendage which may be attached to an object such as a chair arm support for use by a person sitting in a chair.

The present invention also includes an ergonomic arm device 460 for attachment to an object, the ergonomic arm device 460 comprising a bracket 410 as described above and an arm support 462. The arm support 462 is substantially as described above and may include an armrest for engaging at least a portion of an arm; an extension means 16 may be connected to the armrest 12, the extension means 16 may comprise a shroud 350, or a shroud 350 and a linear slide 16, or a linear slide 16 and a pillow block 120 or other suitable roller bearing means or ball bearing arrangement. The shroud 350 or linear slide 16 may be slidable relative to the pillow block 120 and the shroud 350 or linear slide 16 may include a front stop 82 and a rear stop 81. The pillow block 120 may also include a roller bearing means 71 for reducing friction between the shroud 350 or linear slide 16 whereby a wide range of fluid motion is provided for the arm supported by the arm support 462.

In operation, a chair arm pad on a standard office chair 402 is removed from the chair arm support 404 by appropriately loosening the bolts attaching the chair arm pad to the chair arm support 404. The bracket 410 may then be attached to the chair arm support 404 by utilization of the connectors 424.

It should be noted that the means 416 for mating, means 420 for mounting or slots 422 enable an individual to adjustably and releasably affix the bracket 410 to the mounting surface 406. During use of an ergonomic arm support, if an individual desires additional forward extension of the armrest 12, then the individual may position the bracket 410 forwardly upon the mounting surface 406, via the slidable positioning of the connectors 424 within the slots 422. Alternatively, the slots 422 enable the rearward or central positioning of the bracket 410 with respect to the mounting surface 406 as desired by an individual. The connectors 424 may then be tightened by an individual once the appropriate extension of the armrest 12 has been determined. It should also be noted that the releasable feature of the engagement between the connectors 424 within the slots 422 enables an individual to adjust the extension and position of an ergonomic arm support with respect to the mounting surface 406 of a standard desk chair as desired.

In an alternative embodiment, the arm support 10 is provided with an extension support 500 (FIGS. 49–53). In general, the extension support 500 includes a shroud 502 and a cantilever disk 504. The extension support 500 is preferably adapted for affixation to a connector 506 which may be integral to or attached to an object such as a chair or desk or table surface. The connector 506 is preferably a chair arm support, bracket, or spindle of a chair which functions as a base for the extension support 500.

It should be noted that the standard arm pad for a chair arm support is preferably removed to facilitate affixation of the extension support 500 to the connector 506.

The cantilever disk 504 is preferably fixedly attached to the connector 506 through the use of any preferred affixation mechanism 510 including but not limited to bolts and nuts, screws, pins, and/or adhesives. The affixation mechanism 510 preferably traverses a plurality of apertures 512 which pass through the connector 506.

The cantilever disk 504 is generally formed of an upper larger disk 514 and a smaller lower disk 516. The smaller lower disk 516 preferably includes a bottom 518 which may include a plurality of apertures adapted for receiving engagement of the affixation mechanism 510 to fixedly secure the cantilever disk 504 to the connector 506. It should be noted that upon engagement of the affixation mechanism 510 to the connector 506 and the smaller lower disk 516, the cantilever disk 504 is fixedly positioned relative to the object 508.

The upper larger disk 514 is preferably integral to or connected to the smaller lower disk 516 by any means as preferred by an individual including the use of adhesives and/or pins, bolts and nuts, and/or screws. The upper larger disk 514 is preferably cylindrical in shape and may be formed of metal, wood, plastics, hard rubber, and/or a material with a low coefficient of friction such as Teflon® or tetrafluoroethylene material. The smaller lower disk 516 may be formed of the same or different material as the upper larger disk 514 at the preference of an individual. In the preferred embodiment it is anticipated that the smaller lower disk 516 is substantially cylindrical in shape having a smaller diameter than the upper larger disk 516. In addition, in the preferred embodiment it is anticipated that the smaller lower disk 516 is preferably formed of a more sturdy or rigid material for fixed affixation to the connector 506 minimizing the risk of fracture or separation therefrom. It should be further noted that any combination of materials may be selected for the upper larger disk 514 and its smaller lower disk 516 as preferred by an individual provided that the essential functions, features, and attributes described herein are not sacrificed.

The purpose for the cylindrical shape for the upper larger disk 514 is to enable the shroud 502 to be rotated and/or repositioned in a forward, rearward, and/or side-to-side direction relative to an object for positioning of the shroud 502 and an individual's arms in any desired location during use of the arm support 10. The circular shape for the upper larger disk 514 enables an individual to reposition the shroud 502 at any desired location relative to an object.

The cantilever disk 504 is preferably adapted for positioning within the interior 520 of the shroud 502.

In an alternative embodiment the smaller lower disk 516 may include a stem which is adapted for vertical positioning relative to a seat which may either be attached to or integral with the connector 506 or object. The provision of the stem as engaged to the seat may provide for the vertical adjustment of the extension support 500 relative to the object as desired by an individual. However, it should be noted that it is intended for the cantilever disk 504 to be in a fixed nonrotatable position relative to an object in this embodiment.

It should be further noted that the diameter dimensions for the upper larger disk 514 and smaller lower 516 may be reversed or identical at the discretion of an individual provided that the essential functions, features, and attributes described herein are not sacrificed.

As previously indicated, the shroud 502 preferably includes an interior 520, an exterior 526, a first end 528, and a second end 530. The shroud 502 also preferably includes a bottom 532 having an elongate slot 534. The slot 534 preferably traverses the bottom 532 providing for slidable repositioning of the cantilever disk 504 within the interior 520 for repositioning of the arm support in any desired location as preferred by an individual.

The shroud 502 may be square, round, oval, rectangular, or any other shape as desired by an individual provided that the interior 520 does not rotate over the cantilever disk 504 during use of the arm support 10. The shroud 502 may be formed of any material as desired by an individual including but not limited to the use of metal, aluminum, plastics, and/or wood.

Figure 50:
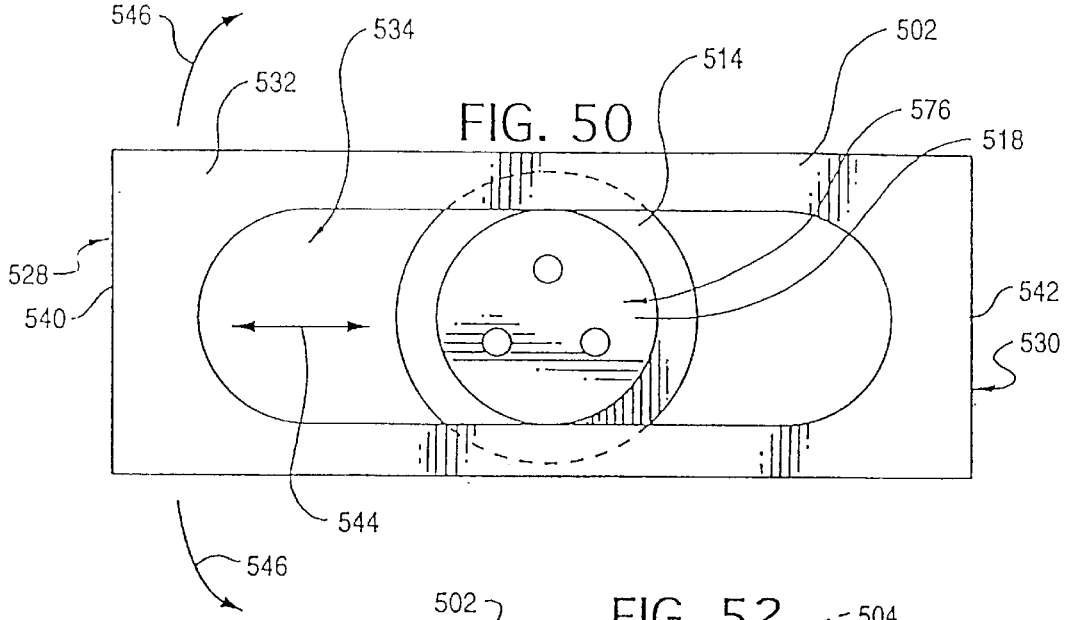
FIG. 50 is a bottom view of the shroud and cantilever disk in partial phantom line.

The first end 528 of the shroud 502 may include an aperture or seat which may additionally include a bushing formed of a plastic with a low coefficient of friction such as Teflon® or tetrafluoroethylene material. The first end 528 may additionally include a forward stop 540 which is preferably used to maintain the cantilever disk 504 within the interior 520 of the shroud 502. In addition, the shroud 502 may include a rear stop 542 proximate to the second end 530 for retention of the cantilever disk 504 within the interior 520 of the shroud 502. The slot 534 preferably functions to enable the forward and/or rearward positioning of the shroud 502 relative to the cantilever disk. The width dimension for the slot 534 is preferably marginally larger than the diameter dimension for the smaller lower disk 516 as depicted in FIG. 50. The positioning of the smaller lower disk 516 within the slot 534 enables the shroud 502 to be slidably positioned forwardly or rearwardly with respect to the cantilever disk 504 during use of the arm support 10. The diameter dimension for the upper larger disk 514 is preferably marginally smaller than the interior width dimension of the interior 520 of the shroud 502. The smaller diameter dimension for the upper larger disk 514 preferably enables the shroud 502 to be positioned inwardly or outwardly from an individual as depicted by arrows 546 on FIG. 50. The forward and rearward positioning of the shroud 502 relative to the cantilever disk 504 and particularly the smaller lower disk 516 is depicted by arrow 544 on FIG. 50.

The shroud 502 is preferably elongate and is also preferably slidably connected to and substantially covering and surrounding the cantilever disk 504 in the preferred embodiment.

Figure 52:
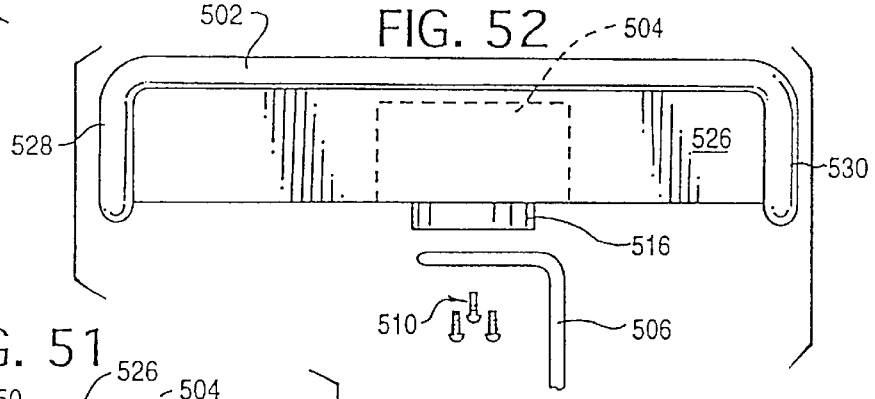
FIG. 52 is an alternative side view of the shroud and cantilever disk in phantom line.

As depicted in FIG. 52, an alternative embodiment may include a shroud 502 which is substantially cup shaped which may be utilized to engage a substantial portion of an arm to be supported during use of the arm support 10. In this embodiment, the cup-shaped shroud 502 preferably eliminates the necessity for use of an armrest 548. In this embodiment the cup-shaped shroud 502 may be covered with a cushioned pad and/or fabric or urethane cover at the discretion of an individual.

Figure 51:
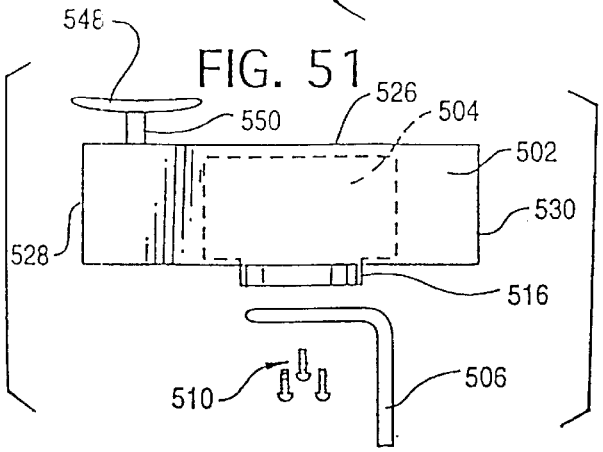
FIG. 51 is an environmental side view of the arm support with cantilever disk in phantom line.

As depicted in FIG. 51, an armrest 548 is preferably engaged to the shroud 502 proximate to the first end 528. The armrest 548 in this embodiment may include a standard 550 adapted for positioning within the bushing or seat traversing the first end 528 of the shroud 502. The standard 550 may further include tiltable and rotatable features enabling the armrest 548 to be rotatably connected to the exterior 526 of the shroud 502. It should be noted that the armrest 548 may preferably be cup shaped and may be adapted to support an arm during use of the armrest 10. In alternative embodiments, the armrest 548 may be disk shaped, or be comprised of an "T-padded bar" at the discretion of an individual. The armrest 548 is preferably adapted for engagement to and support of at least a portion of an arm during use of the armrest 10. The armrest 548 is preferably rotatably connected to the exterior 526 of the shroud 502 proximate to the first end 528 and may be pivotable, tiltable, rotatable, or fixed relative thereto at the discretion of an individual.

During operation, the shroud 502 is fixed positioned relative to an object by the placement of an arm upon the armrest 548 causing a cantilever binding effect between the interior 520 of the shroud 502 and the upper larger disk 514. This cantilever binding effect prevents further movement or rotation of the shroud 502 and armrest 548 relative to the object. Upon removal of an arm from the armrest 548 or shroud 502, force or weight will be withdrawn releasing the cantilever binding effect between the interior 520 of the shroud 502 and the cantilever disk 504. Upon the removal of force or weight and the elimination of the cantilever binding effect, the shroud 502 may be repositioned in either a forward or backward direction 544 or an inward or outward side-to-side direction 546 to a location as desired by an individual. The slidable and pivotal motion of the shroud 502 relative to the object is available due to the diameter of the upper larger disk 514 being smaller than the interior with dimension of the shroud 502 and the positioning and diameter dimension for the smaller lower disk 516 within the slot 534. The cantilever binding effect may be reestablished by the placement of weight or downward force upon the armrest 548 following repositioning of the shroud 502 in a desired location. In this manner, the exertion of downward force or weight upon the armrest 548 or shroud 502 locks out motion of the shroud 502 relative to the object. As the force or weight is increased upon the armrest 548 or shroud 502 a corresponding increase in the cantilever binding effect occurs. A benefit of this embodiment is the elimination of adjustable knobs which are utilized to tighten mechanical affixation means to secure a shroud 502 or armrest 548 into a desired location relative to an object. The use of the cantilever disk 504 within the interior 520 of the shroud 502 eliminates the necessity for mechanical knobs or tightening mechanisms as is known in the art.

The use of the cantilever disk 504 in conjunction with the shroud 502 enables an individual to quickly and easily relocate an armrest 548 relative to the individual or to an object. In addition, the shroud 502 is preferably formed of sturdy and durable material having a high load capacity whereupon the utilization of additional weight results in significantly greater cantilever binding effects for securing the shroud 502 and armrest 548 in a desired location.

Figure 53:
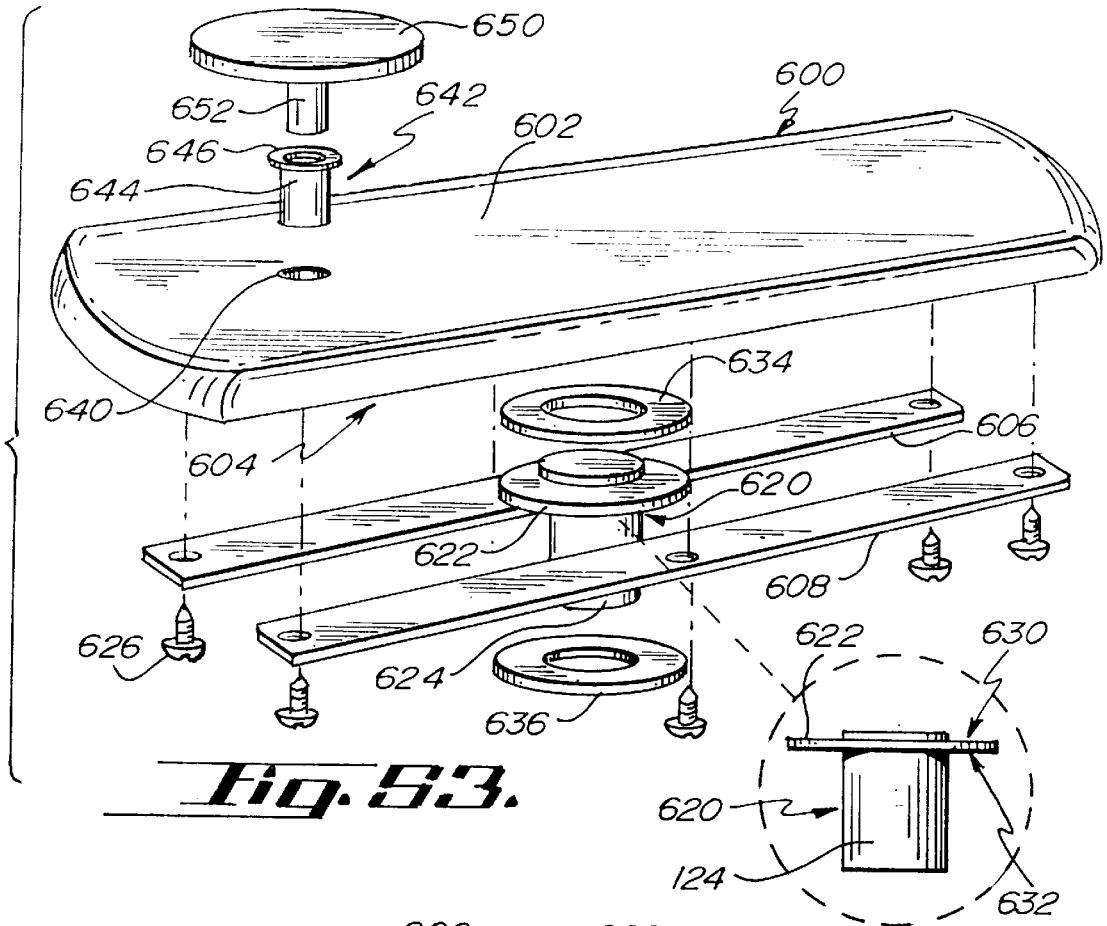
FIG. 53 is an exploded view of another embodiment of the invention.

As depicted in FIG. 53, an alternative embodiment includes a shroud 600 which may be a specially manufactured or may have been previously available and retro-fitted in the manner described below. Preferably shroud 600 is composed at least partially of aluminum. Shroud 600 has an upper surface 602 and a lower surface 604.

Upper surface 604 contains a bushing receiver hole 640. The bushing receiver hole may be located anywhere on the upper surface of the shroud and may penetrate the shroud partially or it may pass entirely therethrough. Inserted into bushing receiver hole 640 is a hollow bushing 642. Bushing 642 has a lip 646 and a shaft portion 644. Shaft portion 644 is receivably engaged within the bushing receiver hole 640. Lip 646 extends beyond the diameter of the bushing receiver hole 640 to prevent the bushing 642 from descending through the shroud 600 and to provide a larger engagement surface for arm pad 650. Preferably bushing 642 is composed of plastic, NYLON, TEFLON, PTF or other material. More preferably the bushing should be characterized as being flexible yet rigid enough to substantially retain its form when in use.

Bushing 640 contains a hollowed portion or channel 648 which receives and frictionally engages the receiving member 652 of arm pad 650. The engagement between receiving member 652 and the bushing channel 648 should be sufficiently tight so that arm pad 650 may be rotated thereabout but not be capable of separating, "wobbling" or moving in an ergonomically undesirable manner. The engagement between receiving member 652 and bushing 640 may be configured such that the arm pad 650 is freely rotatable relative to the shroud 600. Alternatively, the engagement between receiving member 652 and bushing 640 may be configured such that arm pad 650 may be freely rotated relative to shroud 600. Alternatively, the arm pad 650 may be configured to be locked into a desired position relative to the shroud by the placement of a weight, such as provided by resting a user's arm upon the arm pad 650. In such a configuration the weight placed on arm pad 650 may cause the arm pad to lock into position as provided by the downward force of the weight. This locking relationship may exist due to a frictional engagement caused by the penetration of a tapered shaft 644 being downwardly positioned within the bushing receiver hole 640 or due to a cantilever effect between the arm pad 650 and the shroud 600.

The Lower surface 604 may be fitted with a pair of strips or rails 606 and 608. Strips or rails 606, 608 are preferably manufactured from a fairly rigid metal such as aluminum or steel but other materials such as molded plastic may be used. An flange 622 of pin 620 is engaged between the strips or rails 606, 608 and the lower surface 604. Preferably pin 620 is a single piece flanged pin constructed entirely of metal, preferably aluminum.

In order to protect the flange portion 622 of pin 620 from wear or other sorts of damage, the top 630 and bottom 632 of the flange 622 are respectively affixed with two washers 634 and 636. Washers 634 and 636 also provide for a malleable surface for improved securement of the flange 622 between the strips or rails 606, 608 and the lower surface 604. Washers 634 and 636 are preferably composed of NYLON, TEFLON or PTF material.

When the flange 622 and associated washers 606, 608 are engaged in the manner described above, the pin shaft 624 will protrude below the strips or rails 606, 608 and shroud 600. The pin shaft 624 may be affixed to a connector 506 in the manner described in relation to FIGS. 49–53. Alternatively the pin shaft may be retained by base 11 in the manner described in relation to FIGS. 1–2.

In the embodiment shown, strips 606 and 608 are retained against the lower surface 604 by at least two fastening devices 626, such as screws, per strip. Other means of retaining the strips to the shroud may be used such bolts, clips, rivets, adhesives, etc. The pin 620 may be positioned anywhere along the length of the shroud 600, within the confines of the strips 606, 608. The position of the pin 620 may be adjustable to a limited extent by loosening or removing one or more of the fastening devices 626 from the strips 606, 608. Loosening or removing the fastening devices reduces the frictional engagement between the strips 606, 608 against flange 622 and lower surface 604 thereby allowing the pin 620 to be repositioned as desired. Once the pin is placed in the new position the fastening devices may once again affixed as before thus securing the pin in place.

Figure 54:
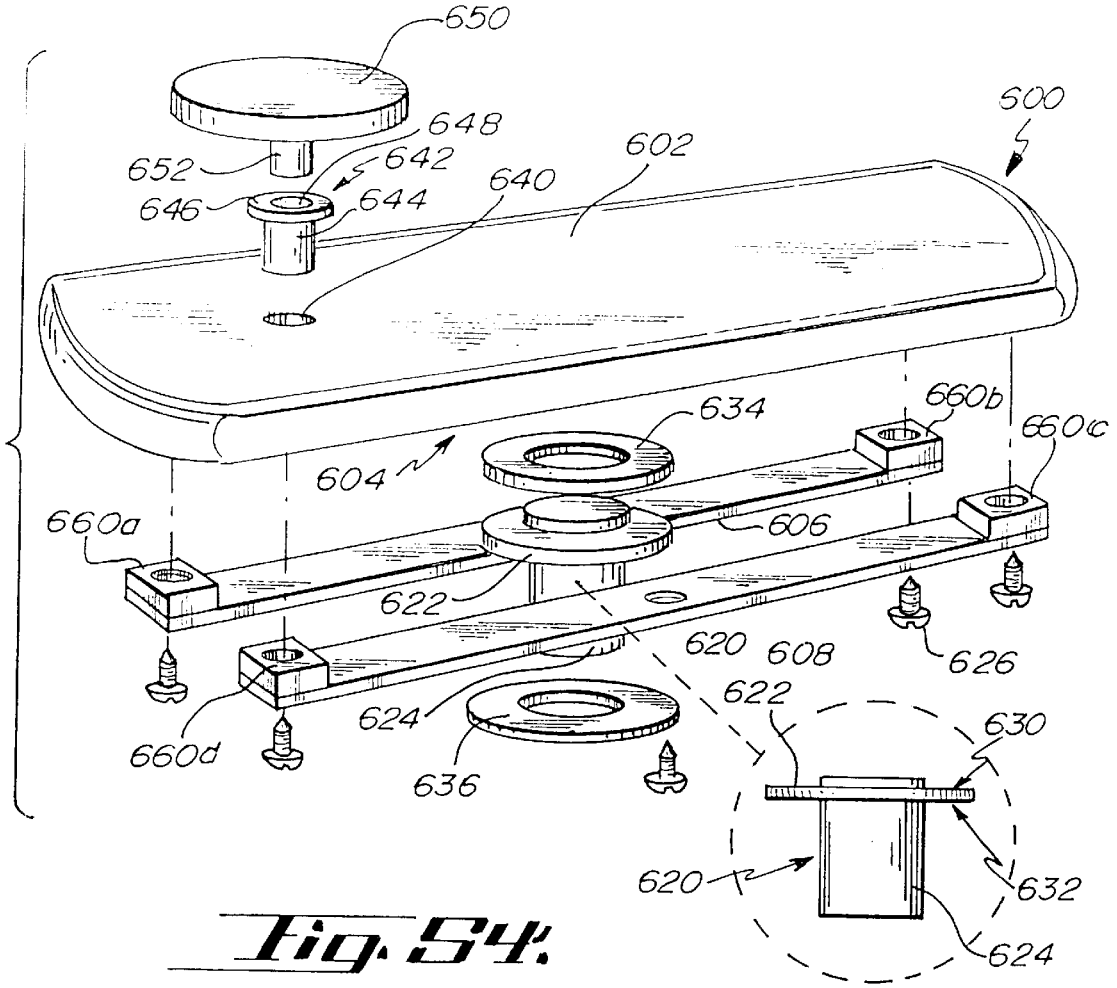
FIG. 54 is an exploded view of another embodiment of the invention.

In the embodiment shown in FIG. 54, when in use the shroud 600 may be freely repositioned and rotated relative to the pin 620. This additional feature is provided by equipping the strips 606 and 608 with a plurality of spacers 660*a*, 660*b*, 660*c* and 660*d*. The spacers provide sufficient space to the flange 622 and associated washers 634 and 636 to allow the shroud 600 to be capable of movement relative to the flange 624 as defined by the confines of the spacers and the strips. The distance between the strips 606, 608 respectively, and the lower surface 604 provided by spacers 660*a*, 660*b*, 660*c* and 660*d* should be substantially equivalent to the collective thickness of the flange 622 and washers 634 and 636.

The movement of the shroud is controlled by the application of force, such as provided by a weight, on the upper surface of the shroud. When weight is placed on the upper surface 602, for instance by placing a user's arm the arm pad 650, the shroud will be forced downward thereby compressing and frictionally engaging the washer 634 against the lower surface 604 and the flange 622 and likewise, compressing and engaging washer 636 against the strips 606, 608 and the flange 622. The downward force provided by the weight of the user's arm results in a cantilever effect caused by the frictional engagement of the flange 622 and the associated washers 634, 636 between the lower surface 604 and the strips 606, 608 which will result in the shroud 600 being held in a single position when in a user's arm or other weighted object rests upon the arm pad 650.

To reposition the shroud 600 upon the pin 620 the user may simply remove the engaging weight from the upper surface 602, slide and/or rotate the shroud in the desired direction(s) then place their arm or weight back on the arm pad 650 or upper surface 602 to engage the pin in place in the manner described above.

The present embodiment provides for a wide range of positioning of the shroud 600 relative to the pin 620. Shroud 600 may be moved forwardly, rearwardly, inwardly and outwardly and rotationally by removing weight from the upper surface 602 of the shroud or arm rest 650. The shroud may be fixed in a desired position by the placement of weight upon the upper surface 602 by an individual.

In the present embodiment it is intended that the shroud 600 be easily slidable relative to pin 620 and a chair or other object (not shown) to which the pin is connected. It is also intended that the shroud be fixed in a desired position by the cantilever effect of downward force a weight upon the shroud or arm rest provides. The application of force upon the shroud which causes the pin and associated washers to be engaged between the strips and lower surface of the shroud, locks the shroud in a desired position relative to the pin and connected surface or object.

Figure 55:
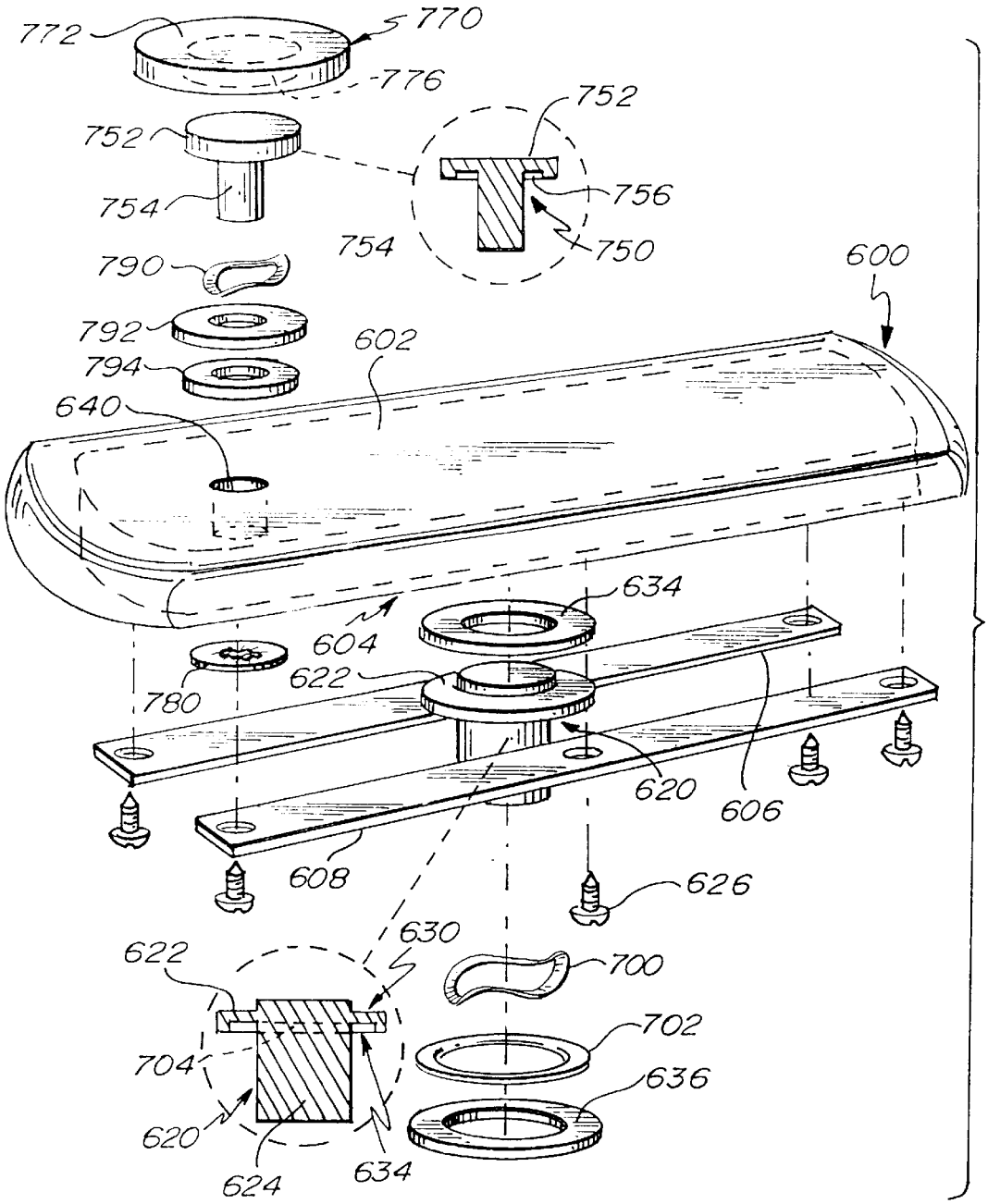
FIG. 55 is an alternative exploded view of another embodiment of the invention.

In an alternative embodiment shown in FIG. 55, the shroud 600 may be easily repositioned yet still be capable of being held in place, relative to pin 620, even without the application of force on the upper surface 602. In the embodiment shown in FIG. 55 a biasing force is provided by spring 700 which provides the flange 622 with an improved engagement against the lower surface 604 and rails 606 and 608. The improved engagement provided by such a biasing force allows the shroud to retain its position relative to the pin 620 with or without an additional downward force or weight upon the shroud, such as previously described.

Spring 700 may be incorporated into the assembly of pin 620 and washers 634, 636. Preferably, the biasing spring 700 is a compression wave spring such as shown, however more conventional biasing members such as coil type springs may be used instead. A relatively flat, compression wave spring of the type which are known in the art are preferred, as such springs assists in maintaining a low profile between the shroud 600, flange 622 and strips 606, 608 when they are arranged together. In addition to the use of relatively flat wave spring 700, the desired low profile arrangement of the various components maybe further reduced by providing the bottom surface 632 of the flange 622 with a hollow or annular groove 704 which may receive most or all of the spring 700 when the spring is pressed between tension ring 702 and flange surface 632.

In the embodiment shown, wave spring 700 is contained between flange 622 and a tension ring 702. Ring 702 prevents washer 636 from being distorted by the biasing force provided by the spring 700 within annular groove 704 and therefore against flange 622, when the strips 606 and 608, pin 620 and shroud 600 are secured together in their assembled form in the manner previously described. As such, ring 702 may be constructed from any material which provides sufficient rigidity to allow the ring to retain its shape while prevent spring 700 from distorting washer 636. Preferably, ring 702 is constructed from metal such as spring steel.

In addition to the biasing spring and associated components described above, the embodiment shown in FIG. 55 also illustrates a unique arm pad assembly which also includes a biasing spring. The arm assembly shown in FIG. 55 and described as follows may be utilized with any embodiment of the present invention.

Rather than utilize a bushing and arm pad pin arrangement to affix the arm pad to the shroud in the manner shown and described in FIGS. 53–54, the embodiment shown in FIG. 55 utilizes a single piece flanged pin 750 to associate the arm pad 770 with the shroud 600.

Pin 750 may be viewed as being made up of components which include an enlarged upper portion or flange 752 and a an elongated member or shaft portion 754. Flange 752 further includes an annular groove 756.

Arm pad 770 includes an upper surface 772 and a lower surface 774. Upper surface 774 may be uniformly shaped, be malleable or have a predetermined shape, such as concave, to better accommodate receipt of a human forearm or wrist (not shown) which may rest thereupon. Lower surface 774 includes a flange receiving area 776 which is a hollow opening sized to receive and retain flange 752 therein. In alternative embodiments flange receiving area 776 may be configured to receive flange 752 in such a manner, so that if desired flange 752 may be later removed from flange receiving area 776. As previously shown in FIGS. 53–54 the arm pad and pin may also be a single one piece assembly.

By receiving flange 752 into flange receiving area 756, the arm pad 770 may be connected to the shroud 600 by inserting the pin shaft 754 into the bushing hole 640. The shaft 754 is sufficiently long to extend completely through the shroud 600. A retaining washer 780 is securingly disposed about the portion of the shaft 754 which protrudes from the lower surface 604 of the shroud 600. The retaining washer has a textured or toothed surface which allows the washer to be retained on the shaft but which allows the washer to be drawn off of the shaft if desired. Toothed retaining washers of the type described are well known in the art. In alternative embodiments the protruding shaft may be secured by a cotter pin or other device affixed to or through the shaft.

In addition to passing through the shroud 600, the shaft 754 is also passed through a biasing spring 790 a ring 792 and a washer 794.

Biasing spring 790 is preferably a compression wave spring of the type previously described, however other types of biasing members may be used. Spring 790 is held, and in use compressed, between annular groove 756 and ring 792. Ring 792 has the same construction and features as ring 702 previously described. Washer 794 has the same construction and features as washers 634 and 636. Washer 794 protects the upper surface 602 of the shroud 600 from ring 792. When the arm pad 770 and associated pin 750 are inserted through and assembled with the other components described above, the spring 790 provides a constant biasing force on the shroud 600 and arm pad 770 which causes the arm pad to remain stationary relative to the shroud unless acted on by a force sufficient to overcome the biasing force. Such force may be provided by the common shifting or movement of a user's arm as it rests on the upper surface of the arm pad. The biasing force provided by the spring 790 provides the present invention with a readily rotatable but highly stable arm pad assembly.

Figure 56:
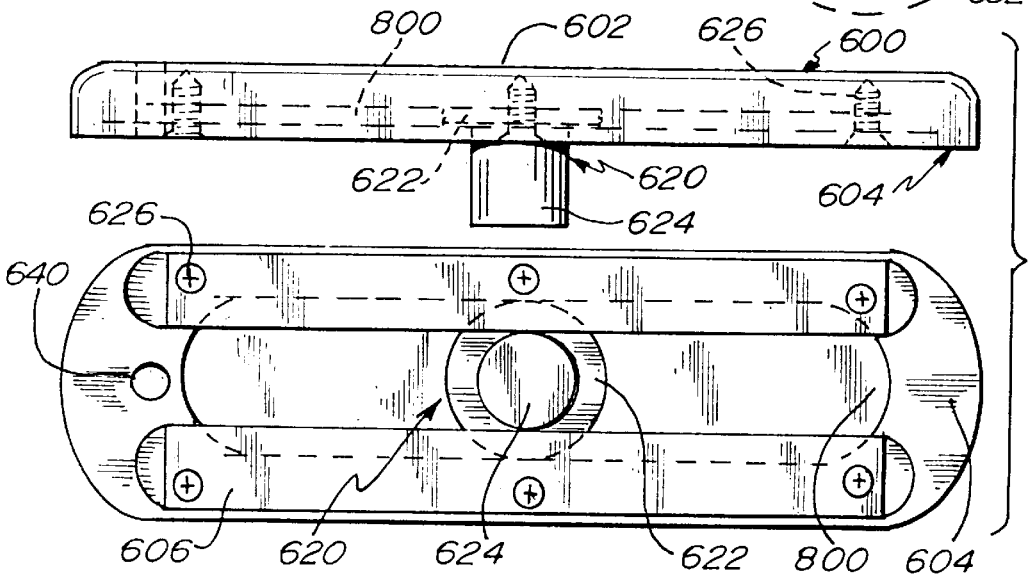
FIG. 56 is an alternative exploded view of another embodiment of the invention.

In the embodiments described in association with FIGS. 53–55, the lower surface 604 of the shroud 600 may include a central groove 800, such as is shown in FIG. 56. Central groove 800 is a hollowed out portion of the shroud, or in the case of a custom manufactured shroud it is merely a shallow portion of the shroud, which is suitably sized to receive the flange 622 and associated washer 634 substantially therein. The central groove 800 defines an area or track in which shroud 600 may be slid or pivoted within relative to the position of the pin 620. The use of a central groove provides the present invention with an even lower profile then the embodiments discussed in FIGS. 53–55.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An arm support, comprising:

an arm pad associated with an elongated member;

a shroud having an upper surface and a lower surface, the upper surface having an opening for receiving the elongated member;

a pin, the pin having a flange and a shaft, the flange having a first diameter, the shaft having a second diameter, the first diameter being larger than the second diameter the flange having a top and a bottom, the pin positioned proximate to the lower surface of the shroud;

a first washer positioned between the top of the flange and the lower surface of the shroud;

a second washer positioned below the bottom of the flange; and a pair of strips, and a plurality of fastening devices adjustably fastening each of the strips to an opposing side of the lower surface of the shroud, the flange being disposed between the strips and the lower surface of the shroud and the shaft disposed between the strips.

2. The arm support of claim 1 wherein the lower surface of the shroud further comprises a central groove, the central groove receiving the flange and the first washer substantially therein.

3. The arm support of claim 1 further comprising a biasing member, the biasing member being held in biased contact between the bottom of the flange and a tension ring, the second washer being in contact with and located immediately below the tension ring.

4. The arm support of claim 3 wherein the bottom of the flange further comprises an annular groove, the annular groove constructed and arranged to receive a substantial portion of the biasing member therein.

5. The arm rest support of claim 3 wherein the biasing member is a compression wave spring.

6. The arm rest support of claim 3 wherein the tension ring is constructed at least partially from steel.

7. The arm rest support of claim 1 wherein the arm pad further comprises a lower arm pad surface, the lower arm pad surface having a receiving region for receiving an enlarged upper portion of the elongated member.

8. The arm rest support of claim 7, further comprising an arm pad biasing member, the arm pad biasing member having an enlarged upper portion, the arm pad biasing member positioned in biased contact between the enlarged upper portion of the biasing member and a tension ring.

9. The arm rest support of claim 8 further comprising a washer located between the tension ring and the upper surface of the shroud.

10. The arm rest support of claim 9, further comprising a retaining device affixed to a portion of the elongated member which protrudes from the lower surface of the shroud, thereby retaining the elongated member in place within the opening.

11. The arm rest support of claim 8 wherein the biasing member is a compression wave spring.

12. The arm rest support of claim 8 wherein the tension ring is constructed at least partially from steel.

13. The arm support of claim 1 wherein the pin is one piece.

14. The arm support of claim 1, wherein the pin is composed of metal.

15. The arm support of claim 1, wherein the shroud is formed of aluminum.

16. The arm support of claim 1 wherein the first washer and the second washer are composed of nylon.

17. The arm support of claim 1 wherein the fastening devices are screws.

18. The arm support of claim 1 wherein the flange, the first washer, and second washer each have a predetermined thickness.

19. The arm support of claim 18 wherein the strips are further characterized as having ends, the ends of the strips having individual spacers placed thereupon, the spacers interposed between the lower surface of the shroud and strips, the spacers having a predetermined thickness substantially equivalent to the predetermined thickness of the flange and associated washers.

20. The arm support of claim 1, wherein the flange and associated washers are frictionally engaged between the strips and lower surface of said shroud by placing a weight upon the arm pad.

21. An arm support, comprising:

an arm pad associated with an elongated member;

a shroud having an upper surface and a lower surface, the upper surface having an opening for receiving the elongated member;

a pin, the pin having a flange and a shaft, the flange having a first diameter, the shaft having a second diameter, the first diameter being larger than the second diameter, the flange having a top and a bottom, the pin positioned proximate to the lower surface of the shroud;

and a pair of strips, and a plurality of fastening devices adjustably fastening each of the strips to an opposing side of the lower surface of the shroud, the flange being disposed between the strips and the lower surface of the shroud and the shaft disposed between the strips.

* * * * *